US007798604B2

(12) United States Patent
Noguchi

(10) Patent No.: US 7,798,604 B2
(45) Date of Patent: Sep. 21, 2010

(54) INKJET PRINTER AND INKJET PRINTING METHOD

(75) Inventor: Eri Noguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 657 days.

(21) Appl. No.: 11/743,295

(22) Filed: May 2, 2007

(65) Prior Publication Data

US 2007/0285451 A1 Dec. 13, 2007

(30) Foreign Application Priority Data

May 9, 2006 (JP) ..... 2006-130791

(51) Int. Cl.

| | |
|---|---|
| ***B41J 29/38*** | (2006.01) |
| ***B41J 2/205*** | (2006.01) |
| ***B41J 2/21*** | (2006.01) |
| ***B41J 2/145*** | (2006.01) |
| ***B41J 2/15*** | (2006.01) |

(52) U.S. Cl. ..... 347/41; 347/14; 347/15; 347/43

(58) Field of Classification Search ..... 347/43, 347/14, 15, 41

See application file for complete search history.

(56) References Cited

U.S. PATENT DOCUMENTS

| | | | | |
|---|---|---|---|---|
| 5,633,663 | A * | 5/1997 | Matsubara et al. | 347/41 |
| 6,273,550 | B1 * | 8/2001 | Brown | 347/43 |
| 6,779,873 | B2 | 8/2004 | Maeda et al. | |
| 6,874,864 | B1 | 4/2005 | Maeda et al. | |
| 2007/0291062 | A1 | 12/2007 | Noguchi et al. | |

FOREIGN PATENT DOCUMENTS

| | | |
|---|---|---|
| JP | 2001-171119 | 6/2001 |
| JP | 2002-096455 | 4/2002 |
| JP | 2002-292910 | 10/2002 |

* cited by examiner

*Primary Examiner*—Julian D Huffman
(74) *Attorney, Agent, or Firm*—Fitzpatrick, Cella, Harper & Scinto

(57) ABSTRACT

An image is output, the image having high quality in which density unevenness due to an end-deviation is excellently reduced in all colors in forming an image with use of a bidirectional inkjet printing head provided with ejection port arrays of a plurality of colors for small droplets of ink. Thereby, distributions of print permission rates of mask patterns to be used in performing a multi-pass printing are made different from each other in accordance with a distance between the two ejection port arrays for the same kind of ink. Thus, the degree of the end-deviation depending on the distance between the two ejection port arrays can be suppressed for every ejection port array.

4 Claims, 24 Drawing Sheets

HEAD SCANNING FORWARD DIRECTION

HEAD SCANNING BACKWARD DIRECTION

INKJET PRINTER AND INKJET PRINTING METHOD

BACKGROUND OF THE INVENTION

1. Field of the Invention

The present invention relates to an inkjet printer and inkjet printing method, in particular, it relates to an inkjet printer and inkjet printing method for printing small droplets at a high density and high frequency.

2. Description of the Related Art

Small droplets, high density nozzles and high driving frequencies have been promoted in inkjet printers. Under such circumstances, there has recently arisen a new problem called "end-deviation."

FIG. 1 is a schematic view showing an "end-deviation." In FIG. 1, the reference numeral 11 denotes a printing head, and the printing head 11 vertically moves while ejecting ink droplets 13 from a plurality of ejection ports arranged on an ejection port surface 14 at a high density. The ejected ink droplets 13 impact a print medium 12 to form a dot. In a high ejecting frequency of the printing head, air with viscosity surrounding the ink droplets 13 move with a movement of the ink droplet 13 flying toward the print medium 12 at a high density. As a result, a pressure in the vicinity of the ejection port surface 14 becomes smaller than that of the periphery of the printing head 11, and air surrounding the above air flows into the decompressed area in a direction shown by the arrows. The airflow especially deflects the ink droplets 13 ejected from the ejection ports positioned at both ends of an ejection port array toward the ejection ports positioned at the center thereof, and makes the ink droplets 13 impact a position deviated from a target position on the print medium 12.

FIG. 2 is a graph showing test results that the inventors performed to check the degree of the above "end-deviation." In this case, the distance (distance to the paper) from the ejection port surface 14 to the print medium 12 was 1.3 mm, 128 ejection ports were arranged at intervals of approximately 21.2 μm, the ejection volume from each ejection port was 2.8 pl, and the ejecting frequency from each ejection port was 25 KHz. In FIG. 2, the horizontal axis indicates each arrangement position of the aligned ejection ports. In addition, the vertical axis indicates a deviation amount of a position, where the ink droplets ejected from each ejection port actually impact, from the target position. Here, in the state shown in FIG. 1, the case of impacting from the right side of the target position is shown as "+," and the case of impacting from the left side is shown as "−." That is, FIG. 2 reveals that the ink droplets ejected from the ejection ports at the outermost both ends are deviated to innermost sides and printed (approximately 10 μm), the deviation amount is slowly reduced as the position of the ejection port becomes close to the center, and that the print position deviation amount of the ink droplets ejected from the center ejection port becomes smallest.

FIG. 3 is a view showing a print state in the case of actually printing a uniform image with the printing head which generates such a print state. The printing head 11 mounted on a carriage moves from left to right in FIG. 3 at a predetermined speed while ejecting ink from each ejection port 31 at a fixed ejecting frequency. An image 32 formed by a first print scanning and an image 33 formed in a second print scanning are shown in FIG. 3. The ink droplets ejected from the ejection ports at the end of the printing head are deflected toward the center of the printing head to impact the print medium, and thus an area to be naturally printed by the ink droplets ejected from the ejection ports at the end appears as a blank area 34.

Such a blank area 34 is generated at each connecting part between the print scans to lower the quality of a uniform image area.

The "end-deviation" is generally easily checked as the ejection volume becomes small, the ejecting frequency is high and the arrangement density of the ejection ports is high, in particular, it becomes apparent when the ejection volume is not more than 10 pl.

FIG. 4 is a graph showing a relationship between the ejection volume and the print position deviation amount examined by the inventors. Here, the horizontal axis indicates variation of the ejection volume from approximately 5 pl to 16 pl, and the vertical axis indicates the print position deviation amount of the ink droplet ejected from the ejection port at the end with use of a printing head having the same conditions as the printing head shown in FIG. 1. FIG. 4 reveals that the print position deviation amount becomes large as the ejection volume becomes small. For this reason, it is considered that, as the ink droplet becomes small, the rate of the surface area to the weight of the ink droplet is increased and the ink droplet easily receives influence from airflow.

Regarding the "end-deviation" as described above, various countermeasures have been proposed. For example, Japanese Patent Laid-Open No. 2002-096455 discloses a method for reducing the adverse effects of the "end-deviation" by providing a mask pattern to be used in performing a multi-pass printing method with features. The method will be described hereinafter.

FIG. 5 is an explanatory schematic view of the multi-pass printing method. Here, a two-pass type multi-pass printing method is shown which completes an image in an arbitrary area by two print scans. In FIG. 5, the reference numeral 1200 denotes a printing head having ejection port arrays for four colors. The printing head 1200 ejects ink droplets while moving in a main scanning direction in FIG. 5 to print dots onto the print medium.

However, in the multi-pass printing method, printing is not performed for all printable pixels by only one print scan. For example, in the two-pass type multi-pass printing, printing is performed for approximately half of all the printable pixels via the ejection ports positioned at the lower half part of the printing head 1200 in a first print scanning. And after the first print scan, the print medium is conveyed by a length corresponding to half of a print width of the printing head 1200 in a sub-scanning direction in FIG. 5.

In the subsequent second print scan, printing is performed for the remaining pixels via the ejection ports positioned at the upper half part of the printing head 1200 in the image area where the printing has already been performed for approximately half of all the pixels by the first print scan. In addition, in the second print scanning, the lower half part of the printing head 1200 performs printing for the pixels of approximately half of the blank area adjacent to the image area. When the second print scanning ends, the print medium is further conveyed by the length corresponding to a half of the print width of the printing head 1200 in the sub-scanning direction in FIG. 5.

In the two-pass type multi-pass printing method, the image is formed in stages by alternately repeating the above print main scanning for half of all the pixels and the sub-scanning of the length corresponding to half of the print width. According to the multi-pass printing method, the image is formed in the identical image area on the print medium by a plurality of print scan via the ejection port groups different from each other in the printing head. Accordingly, even if there are variations in the ejecting direction and the ejection volume of the ejection port, and even if there are some variations in conveying amount of the print medium, it is possible to make the adverse effects due to the variations inconspicuous on the image.

Moreover, although the two-pass type multi-pass printing method for completing an image by the two print main scannings is described above with reference to FIG. 5, the number of multi-pass is not limited thereto. As the number of print scannings is increased, a formed image becomes excellent in uniformity.

When the above-described multi-pass printing method is employed, a mask pattern, in which permission or non-permission of printing is determined, is frequently used in order to determine pixels for which the printing is to be performed by each print main scanning. Various image quality items other than uniformity can be improved by providing such a mask pattern with various features.

FIG. 6 is disclosed in Japanese Patent Laid-Open No. 2002-096455, and is a view showing mask patterns which are improved to avoid the end-deviation. Here, a printing head having 768 ejection ports is employed, and mask patterns used for performing four-pass type multi-pass printing is shown. The size of the mask pattern is 768 pixels corresponding to the number of ejection ports in a vertical direction, and 256 pixels in a horizontal direction. A pixel shown by black is a print permission pixel, and a pixel shown by white is a print non-permission pixel. The print permission or print non-permission of each pixel is determined so that the four mask patterns corresponding to four ejection port groups respectively are complementary to each other.

As shown in FIG. 6, a bias is provided between the numbers of print permission pixels in accordance with positions of the ejection ports. A print permission rate of the ejection port at the end is lowered compared with that of the center so that adverse effects due to impact position deviations of the ink droplets ejected from the ejection ports at the end can be made inconspicuous.

Japanese Patent Laid-Open No. 2002-096455 discloses a constitution in which the bias is provided between the numbers of print permission pixels in accordance with positions of ejection ports. Furthermore, the same Patent Document discloses that it is effective to lower the print permission rate of the ejection port positioned at the end compared with that of the ejection port positioned at the center as shown in FIG. 6 to reduce the "end-deviation."

On the other hand, Japanese Patent Laid-Open No. 2002-292910 discloses mask patterns further advanced from the invention disclosed in Japanese Patent Laid-Open No. 2002-096455. Regarding a color inkjet printer for printing while bidirectionally moving a plurality of ejection port arrays, it is known that color unevenness arises owing to a difference between the scanning forward direction and scanning backward direction in the ink dropping order onto paper. Japanese Patent Laid-Open No. 2002-292910 aims at reducing such color unevenness and discloses mask patterns in which peaks of the print permission rates of colors are made different from each other.

On the other hand, in order to reduce the above color unevenness, a printing head has been recently provided in which the ejection port arrays of each color are arranged so as to be symmetrical in the scanning direction of the printing head. The printing head is referred to as "bidirectional head" hereinafter. The color unevenness will be briefly described hereinafter.

In the case of a general printing head, which is not the bidirectional head, ejection port arrays, in which one array is provided for every color, are generally arranged asymmetrically, and the ink dropping order to the print medium of the forward print scanning is reverse to that of the backward print scanning. For example, when a green image is printed, a print scanning for dropping yellow ink after dropping cyan ink and a print scanning for dropping cyan ink after dropping yellow ink are alternately repeated, and two kinds of green bands are alternately arranged in the sub-scanning direction. In the inkjet printing, the difference between the ink dropping order appears in a hue difference to some extent. When the hue difference can be visually recognized, the color unevenness causes an adverse effect to degrade the image. In order to avoid the adverse effects of color unevenness, the bidirectional head has been proposed in Japanese Patent Laid-Open No. 2001-171119.

FIG. 7 is a schematic view showing an example of arrangement states of the ejection port arrays in the bidirectional head. A printing head 800 has six ejection port arrays 801 to 806 each in which 128 ejection ports for ejecting ink droplets of 2.8 pl are arranged at pitches of 600 dpi. The ejection port arrays 801 and 806 eject cyan ink, the ejection port arrays 802 and 805 eject magenta ink, and the ejection port arrays 803 and 804 eject yellow ink. The two ejection port arrays (for example, 801 and 806) for ejecting the same color ink are arranged so as to deviate from each other by a half pitch (corresponding to 1200 dpi) in the sub-scanning direction. Accordingly, the printing head 800 performs ejecting operation while being moved in the main scanning direction so that an image can be formed in the sub-scanning direction at a printing resolution of 1200 dpi.

In such an arrangement of the ejection port arrays, the ink dropping order to the print medium is cyan, magenta, yellow, yellow, magenta and cyan in the forward print scanning and backward print scanning. Accordingly, the color unevenness due to the difference between the ink dropping order is prevented.

However, as the inventors carried out a diligent examination, a phenomenon was confirmed that the degrees of the end-deviation as described in the related art are different in every ejection port array in such a symmetrical type printing head.

FIG. 8 is a graph showing test results performed by the inventors. Here, the printing head shown in FIG. 7 is used in the test, and a state of the end-deviation of the ejection port arrays of each color in printing a monotone image of each color while changing a print duty is shown. As printing conditions, the distance between the ejection port surface of the printing head and the print medium (distance to the paper) was 1.15 mm, the moving speed of the carriage was 25 inch/sec, the driving frequency of the printing head was 30 KHz, and the printing resolution was 1200 dpi.

In FIG. 8, the horizontal axis indicates the print duty, and the print duty becomes 100% when the ink is ejected to all printing pixels arranged at 1200 dpi. On the other hand, the vertical axis indicates the deviation amount of the position where the ink droplets impact, the droplets being ejected from the ejection ports positioned at both ends of the ejection port array. In addition, a curved line 901 indicates a print position deviation amount of the ejection port arrays of yellow (803 and 804), and a curved line 902 indicates a print position deviation amount of the ejection port arrays of cyan (801 and 806).

As shown in FIG. 8, both the print position deviation amounts of the ejection port arrays for the two colors are increased as the printing duty is increased. However, the degrees of the deviation amounts are different from each other. That is, referring to FIG. 7 again, the two ejection port arrays of yellow (803 and 804), which are arranged adjacently to the center of the printing head, have an end-deviation amount larger than that of the two ejection port arrays of cyan (801 and 806) which are arranged away from the center. Although not shown in FIG. 8, a locus showing a print position deviation amount of the ejection port arrays of magenta arranged between the ejection port arrays of cyan and the ejection port arrays of yellow is obtained between the curved line 901 of yellow and the curved line 902 of cyan.

The above description reveals that the degree of the end-deviation has a relationship with the distance between the two ejection port arrays. As to the reason, it is considered that force for drawing the peripheral air in ejecting varies depending on an arrangement density of the ejection ports, that is, a distance between the two ejection port arrays.

FIG. 9A and FIG. 9B are schematic views each showing a relationship between the arrangement density of the ejection ports and airflow, and each shows an example of arrangement of the ejection ports for printing a single color image of 1200 dpi in the sub-scanning direction. FIG. 9A shows two ejection port arrays separated from each other at the distance d1, and FIG. 9B shows two ejection port arrays separated from each other at the distance d2 shorter than d1. In both examples, the image can be printed at the printing density of 1200 dpi in the sub-scanning direction. However, since it is considered that the amount of airflow having a risk of causing the end-deviation depends on the arrangement density of the ejection ports, it is anticipated that the amount of air flow generated under a higher arrangement density shown in FIG. 9B is larger. That is, referring to FIG. 7 again, it is assumed that the amount of airflow generated by the ink droplets ejected from the ejection port arrays of yellow (803 and 804) having an arrangement similar to that shown in FIG. 9B is larger than that from the ejection port arrays of cyan (801 and 806) having an arrangement similar to the arrangement shown in FIG. 9A, and that the end-deviation arises more easily in the arrangement shown in FIG. 9B. This is consistent with the results shown in FIG. 8.

Although image adverse effects due to the above-described end-deviation becomes apparent in full color print for printing an image with all ink colors, it becomes more apparent in mono color print for printing an image with a single color ink. This is because, in the mono color print, a contrast in a single color image is relatively high and the end-deviation can be easily checked as white streaks. When the printing head shown in FIG. 8 is employed, there arises a problem that the degree of the end-deviation, the degree of the image adverse effects, depends on the ink color to be used even in a mono color print.

No acceptable image can be obtained even when the mask patterns (shown in FIG. 6) disclosed in Japanese Patent Laid-Open No. 2002-096455 are commonly employed for all the ejection port arrays of such a printing head. When it is assumed that, for example, the mask patterns shown in FIG. 6, in which the print permission rates are extremely fluctuated, are employed for the ejection port arrays of cyan shown in FIG. 7 having a small end-deviation amount, the original effect of the multi-pass printing is lost, density variation originally present in the ejection port array is not corrected, and density unevenness is caused.

As the inventors diligently examined, they judged that, when the mask patterns disclosed in Japanese Patent Laid-Open No. 2002-096455 are employed, it is important to adjust the distribution of the print permission rates of nozzles in the ejection port array in accordance with the degree of the actual end-deviation. That is, while aiming at reducing the end-deviation, the distribution of the print permission rates in the same ejection port array is required to be determined so that new adverse effects do not arise. Accordingly, it is considered that it is necessary to determine the distribution of the print permission rates for every individual ejection port array in the case where the degrees of end-deviation of the ejection port arrays for colors are different from each other like the bidirectional printing head disclosed in Japanese Patent Laid-Open No. 2001-017111.

Japanese Patent Laid-Open No. 2002-292910 discloses mask patterns in which the print permission rates are optimized for every ejection port array. However, the mask patterns are merely provided to avoid the color unevenness, and no bidirectional printing head as shown in FIG. 7 is supposed in the invention of the above Patent Document. By using the bidirectional printing head, the color unevenness is avoided. In order to solve a new problem due to the constitution of the bidirectional printing head, the present invention aims at optimizing the print permission rates for every ejection port array.

SUMMARY OF THE INVENTION

It is an object of the present invention to output an image having high quality in which density unevenness due to an end-deviation is excellently reduced in forming an image using an inkjet printing head provided with ejection port arrays of a plurality of colors for ejecting small droplets.

The first aspect of the present invention is an inkjet printer for printing an image on a print medium by performing ejecting ink from a printing head having at least first ejection port arrays and second ejection port arrays based on print permission rates determined in advance to a for the respective first and second ejection port arrays while making a moving the printing head scan in relation with respect to the print medium, wherein the printing head having an arrangement of at least the plurality of the first ejection port arrays corresponding to for ejecting a first kind of ink and a plurality of the second ejection port arrays corresponding to for ejecting a second kind of ink are arranged in a moving direction, and wherein a distance between the first ejection port arrays is shorter than a distance between the second ejection port arrays, and a difference between print permission rates of an end ejection port and center ejection port in the first ejection port array is larger than a difference between print permission rates of an end ejection port and center ejection port in the second ejection port array.

The second aspect of the present invention is an inkjet printer for printing an image in on an identical print area of a print medium by making moving a printing head scan in relation with respective to the identical area of a print medium a plurality of times, wherein the printing head has two first ejection port arrays for ejecting a first kind of ink and two second ejection port arrays for ejecting a second kind of ink, and wherein a distance between the two first ejection port arrays is different from a distance between the two second ejection port arrays, and wherein a distribution of print permission pixels of a mask pattern corresponding to the first ejection port arrays is different from a distribution of print permission pixels of a mask pattern corresponding to the second ejection port arrays.

The third aspect of the present invention is an inkjet printing method for printing an image on a print medium by performing ejecting ink from a printing head having at least first ejection port arrays and second ejection port arrays based on print permission rates determined in advance to a for the respective first and second ejection port arrays while making a moving the printing head scan in relation with respective to the print medium, wherein the printing head having an arrangement of at least the plurality of the first ejection port arrays corresponding to for ejecting a first kind of ink and a plurality of the second ejection port arrays corresponding to for ejecting a second kind of ink are arranged in a scanning moving direction, wherein a distance between the first ejection port arrays is shorter than a distance between the second ejection port arrays, and a difference between print permission rates of an end ejection port and center ejection port in the first ejection port array is larger than a difference between print permission rates of an end ejection port and center ejection port in the second ejection port array.

Further features of the present invention will become apparent from the following description of exemplary embodiments (with reference to the attached drawings).

DESCRIPTION OF THE EMBODIMENTS

An embodiment of the present invention will be described below citing a serial type inkjet printer having a printing head provided plurality of ejection port array as an example.

Figure 10:
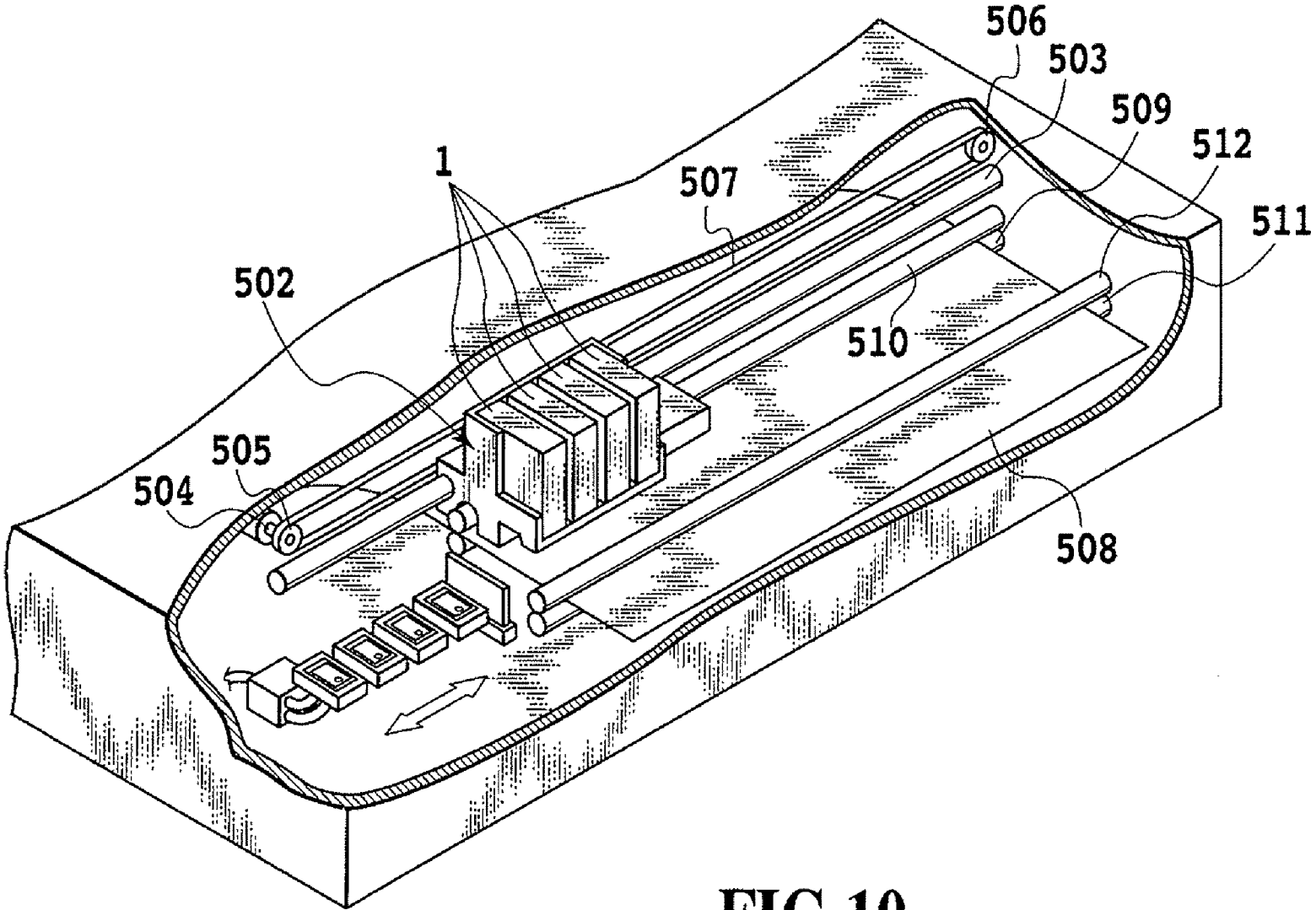
FIG. 10 is a schematic perspective view showing a main part of an inkjet printer according to an embodiment of the present invention.

FIG. 10 is a schematic perspective view showing a main part of an inkjet printer according to the embodiment of the present invention. In FIG. 10, the reference numeral 502 denotes a carriage, and printing heads 1 and ink tanks for supplying ink of four colors thereto are changeably mounted on the carriage 502.

The ink of four colors are printable via the printing head 1, and cyan ink, magenta ink, yellow ink and black ink are respectively supplied from the ink tanks. The printing head 1 is positioned and changeably mounted on the carriage 502, a connector holder (electrical connecting part), in which a driving signal, etc., is transmitted to the printing head 1 via a connector, is provided on the carriage 502.

The carriage 502 moves along a guide shaft 503 provided in an apparatus main body while being guided and supported in a main scanning direction. Driving force of a main scanning motor 504 is transmitted to a motor pulley 505, a following pulley 506 and a timing belt 507, and thus the carriage 502 moves, and a position and a movement amount thereof are controlled.

A print medium 508 such as a sheet of paper or plastic thin plate is conveyed so as to pass through a position (print part) opposite a ejection port surface of the printing head 1 by rotation of two sets of conveying rollers (509 and 510, and 511 and 512). Moreover, the back side of the print medium 508 is supported by a platen (not shown) so that the print medium 508 can form into a flat printing surface in the print part. The ejection port surface of the printing head 1 mounted on the carriage 502 is projected downward from the carriage 502 and held between the two sets of conveying rollers (509 and 510, and 511 and 512) so as to be kept parallel with the print medium 508.

Figure 11:
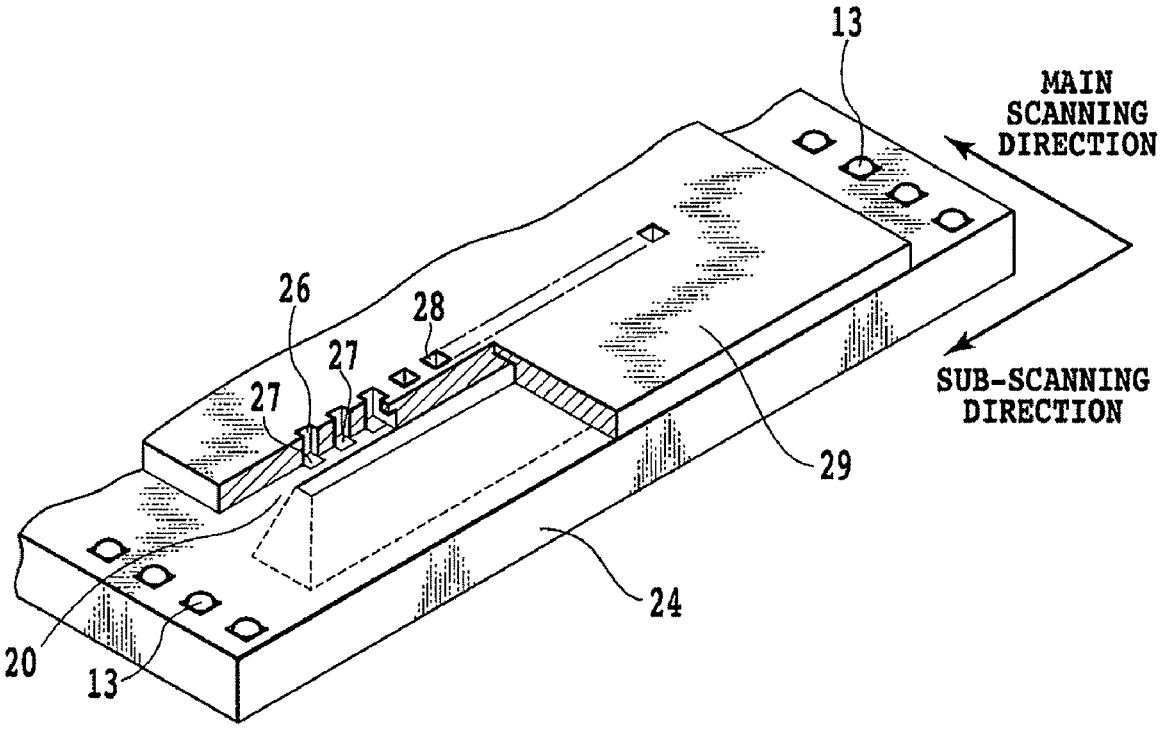
FIG. 11 is across-sectional view of a ejection portion of a printing head.

FIG. 11 is a cross sectional view of an ejection portion of the printing head 1. In FIG. 11, the reference numeral 24 denotes a substrate composed of a silicon wafer. The substrate 24 is a part of an ink flow path constituting member, and serves as a supporting body of a material layer forming electrical thermal converters (heaters), ink flow paths and ejection ports. In the embodiment, the substrate 24 may be composed of glass, ceramics, plastic, metal, etc., other than silicon.

Electric thermal converters (heater) 27, which are thermal energy generating means, are arranged on the substrate 24 at 600 dpi pitches in a longitudinal direction of an ink supplying port 20.

A coated resin layer 29 for introducing the ink into each heater is adhered to the substrate 24. Flow paths 26 and the ink supplying port 20 are formed in the coated resin layer 29, the flow paths 26 each being formed at the position corresponding to the heater, and the ink supplying port 20 being capable of evenly supplying the ink to each flow path 26. A tip of each flow path 26 forms into an ejection port 28, for ejecting ink droplets caused by a film boiling by the heater 27.

One kind of ink is supplied to one ink supplying port 20. A plurality of ink supplying ports 20 are juxtaposed on the substrate 24, and various kinds of ink can be respectively ejected from the ink supplying ports 20. Arrangement of ejection ports of each color of the printing head used in the embodiment will be described in detail hereinafter.

Figure 12:
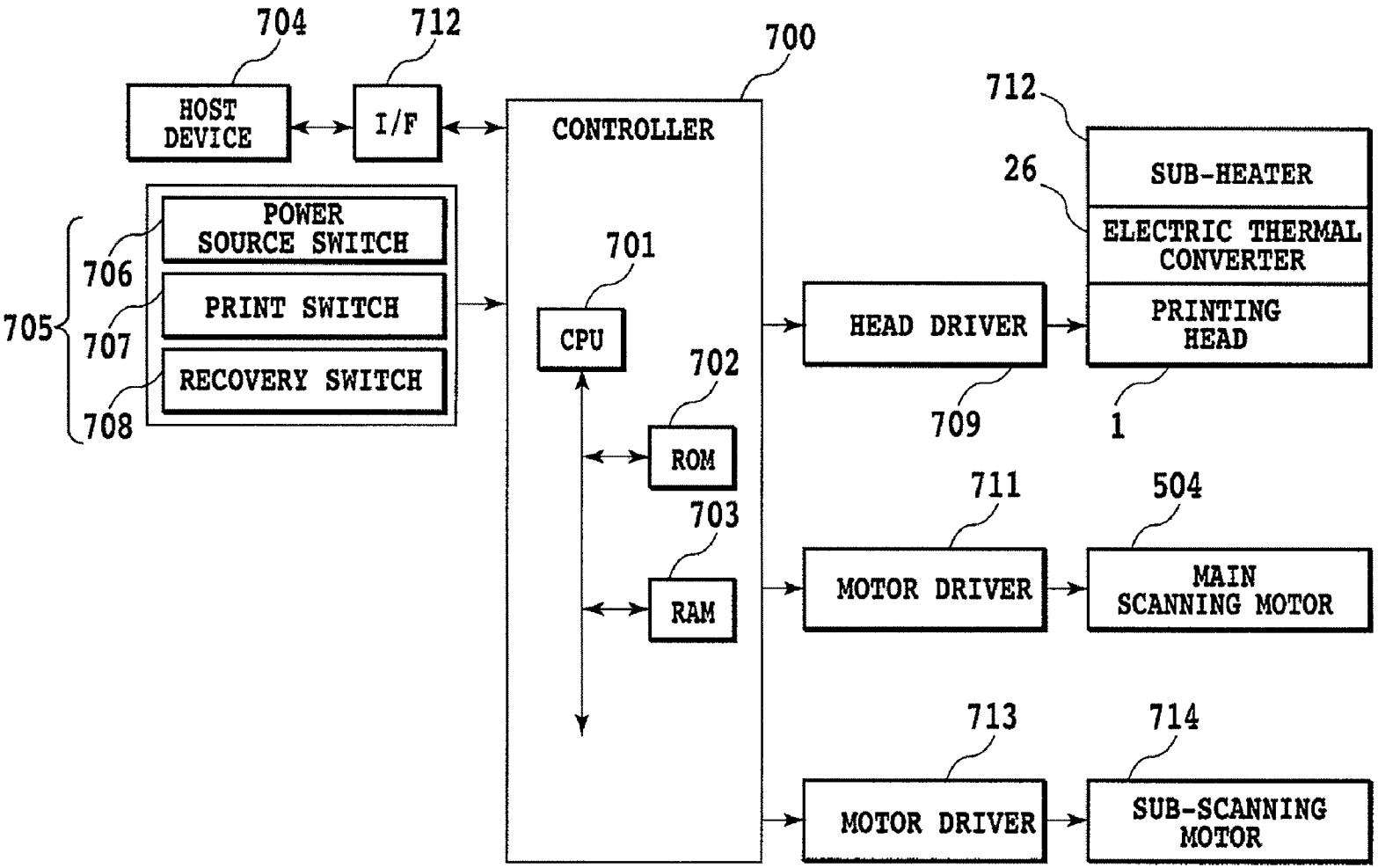
FIG. 12 is a block diagram illustrating a control constitution of the inkjet printer according to the embodiment of the present invention.

FIG. 12 is a block diagram illustrating a control constitution of the inkjet printer according to the embodiment. In FIG. 12, a controller 700 is a main controller, and includes: a CPU 701 in the form of, for example, a micro-computer; a ROM 702 in which a program, a desired table and other fixed data are stored; and a RAM 703 in which an area for development of image data, an area for working, etc. A mask pattern to be used in the embodiment is stored in the ROM 702. CPU 701 generates print data for each print scanning, using a logical AND operation of image data supplied from host device 704 and a mask pattern read from ROM 702. Then, CPU 701 supplies the print data for each print scanning to head driver 709.

A host device 704 connected to the exterior of the printer is a supplying source of the image data. The device 704 may be a computer for preparing and processing data such as an image to be printed, a reading part for reading the image, etc. Image data, other commands, status signals, etc., are transmitted/received to/from the controller 700 via an interface (I/F) 712.

An operating part 705 is a switch group for receiving an instruction input from an operator, and includes: a power source switch 706; a print switch 707 for instructing the controller to start printing operation; and a recovery switch 708 for instructing the controller to start maintenance processing for the printing head.

A head driver 709 is a driver for driving the electric thermal converters 26 of the printing head 1 in accordance with print data, etc. The head driver 709 includes: a shift register for making the print data align in accordance with the positions of the electric thermal converters 26; a latch circuit for latching at a proper timing; a logic circuit element for operating the electric thermal converters 26 in synchronization with a driving timing signal; a timing setting part for suitably setting a driving timing (ejecting timing) for dot formation positioning; etc.

A sub-heater 712 is provided in the printing head 1. The sub-heater 712 performs a temperature adjustment for stabilizing ink ejecting features. Although the sub-heater 712 may be formed on the substrate 24 of the printing head together with the electric thermal converter 26, this may be attached to a main body of the printing head 1.

A motor driver 711 is a driver for driving the main scanning motor 504, and a motor driver 713 is a driver for driving a sub-scanning motor 714 for generating force for rotating the conveying rollers.

Figure 13:
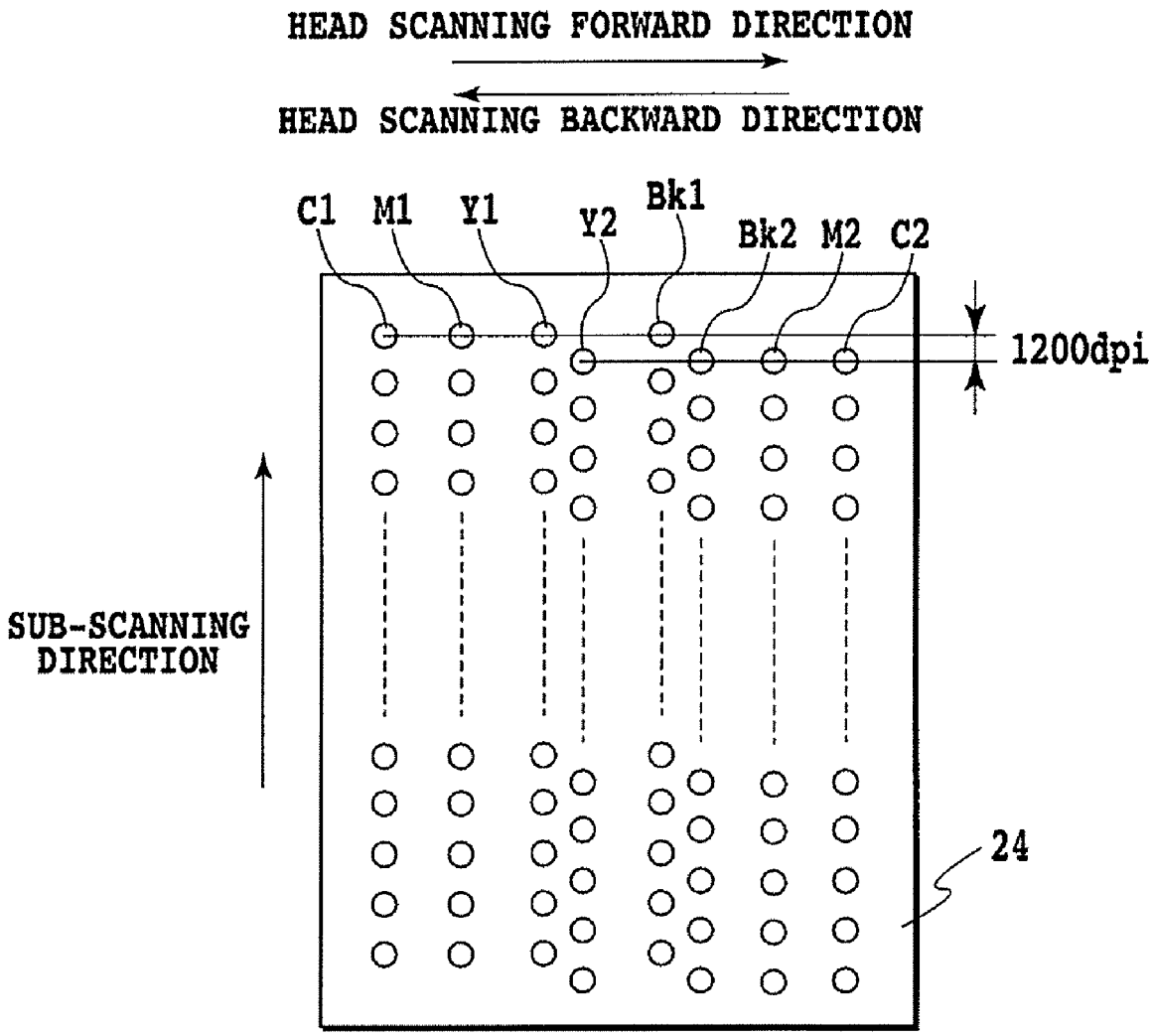
FIG. 13 is a view showing the printing head, which is observed from an ejection port surface side, according to a first embodiment of the present invention.

FIG. 13 is a view showing the printing head 1 observed from an ejection port surface side, according to the first embodiment. The eight ejection port arrays are arranged on the substrate 24. Cyan ink is ejected from the ejection port arrays C1, C2, magenta ink is ejected from the ejection port arrays M1, M2, yellow ink is ejected from the ejection port arrays Y1, Y2, and black ink is ejected from the ejection port arrays Bk1, Bk2. Ink droplets of 2.8 pl are ejected from each ejection port. 128 ejection ports are arranged in each ejection port array at 600 dpi pitches, and the two ejection port arrays for ejecting the same color ink are deviated from each other by a half pitch. Accordingly, in each print main scanning, regarding all the colors, printing can be performed for 256 pixels at a printing density of 1200 dpi in the sub-scanning direction.

In the embodiment, the distance between the ejection port arrays C1 and C2 is 7.39 mm, the distance between the ejection port arrays M1 and M2 is 4.64 mm, and both the distances between the ejection port arrays Y1 and Y2 and between Bk1 and Bk2 are respectively 0.25 mm.

Figure 14:
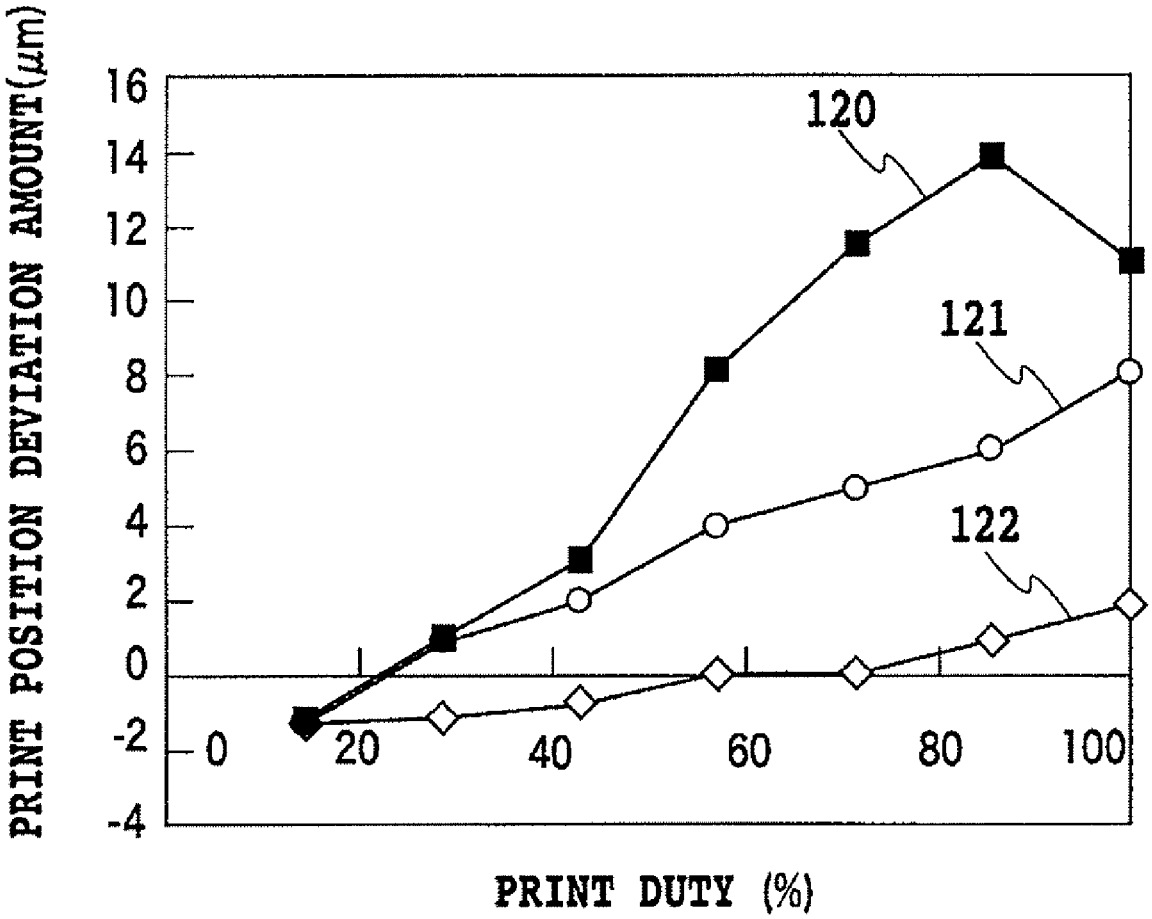
FIG. 14 is a graph showing a state of the end-deviation of ejection port arrays of each color in printing a monotone image of each color by a two-pass type multi-pass printing while changing a print duty.

FIG. 14 is a graph showing a state of the end-deviation of ejection port arrays of each color in printing a monotone image of each color by a two-pass type multi-pass printing while changing a print duty with use of the printing heads 1. As a mask pattern in the multi-pass printing, a mask pattern having a print permission rate of 50% uniformly across the entire ejection port area is commonly employed for the ejection port arrays for all the colors. As printing conditions, the distance to paper was 1.15 mm, the moving speed of the carriage was 25 inch/sec, and the driving frequency of the printing head was 30 KHz. In FIG. 14, a curved line 120 indicates a print position deviation amount of the end of the ejection port arrays Y1, Y2 of yellow, a curved line 121 indicates a print position deviation amount of the end of the ejection port arrays M1, M2 of magenta, and a curved line 122 indicates a print position deviation amount of the end of the ejection port arrays C1, C2 of cyan. A locus of a print position deviation amount of the end of the ejection port arrays Bk1, Bk2 of black is almost similar to the curved line 120 of yellow.

In the embodiment, the two-pass type multi-pass printing is performed using the printing head 1 having the above-described constitutions and features.

Figure 15:
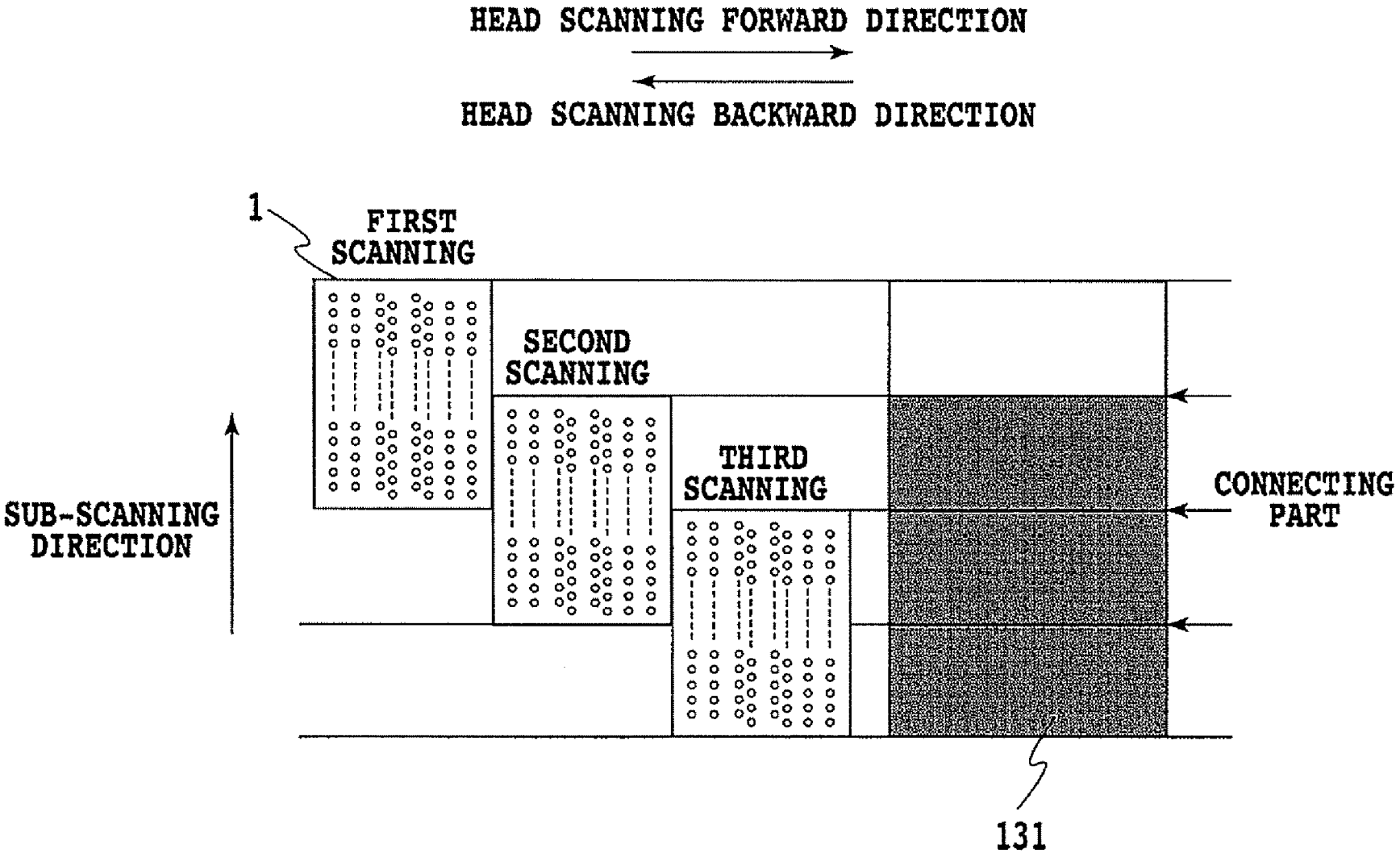
FIG. 15 is a view showing a print state in performing the two-pass multi-pass printing.

FIG. 15 is a view showing a print state in performing the two-pass printing using the printing heads 1. In FIG. 15, the printing head 1 performs ejecting ink while reciprocating in the main scanning direction so that dots are printed on the print medium.

In a first print scanning, printing is performed for pixels of approximately 50% in forward direction via the 128 ejection ports of each color positioned at the lower half part of the printing head 1. When the first print scanning ends, the print medium is conveyed by a length corresponding to half of a print width of the printing head 1 in the sub-scanning direction in FIG. 15.

Figure 1:
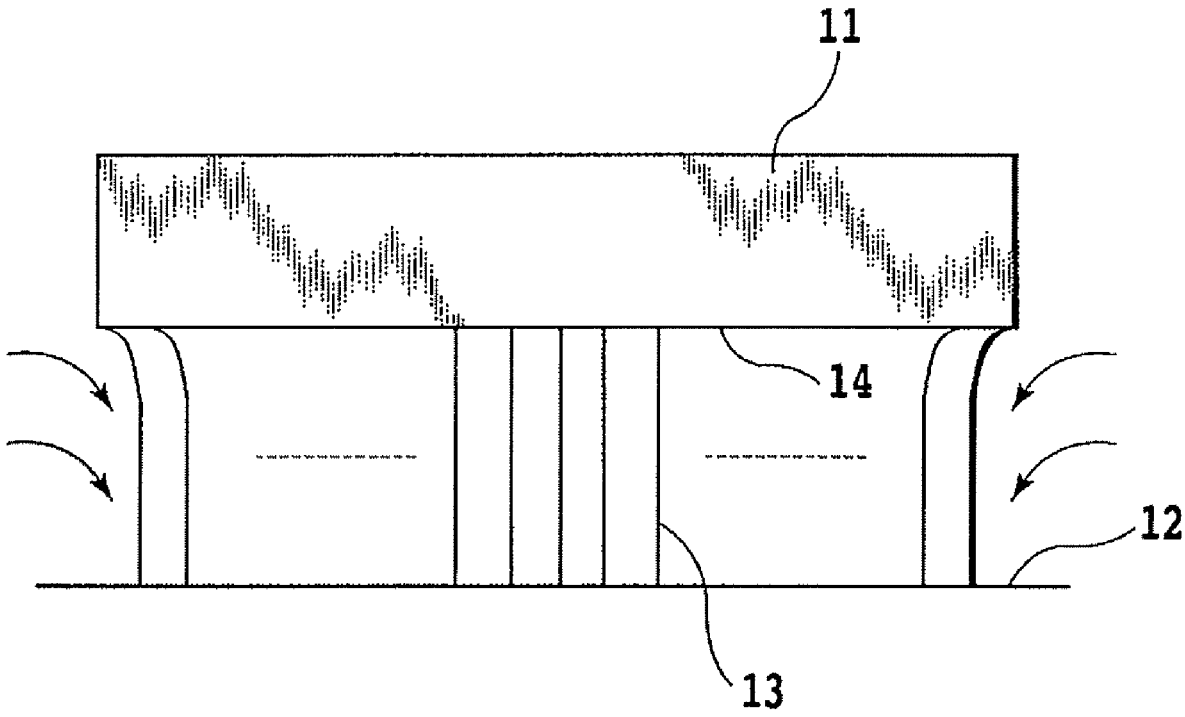
FIG. 1 is a schematic view showing an "end-deviation"
Figure 2:
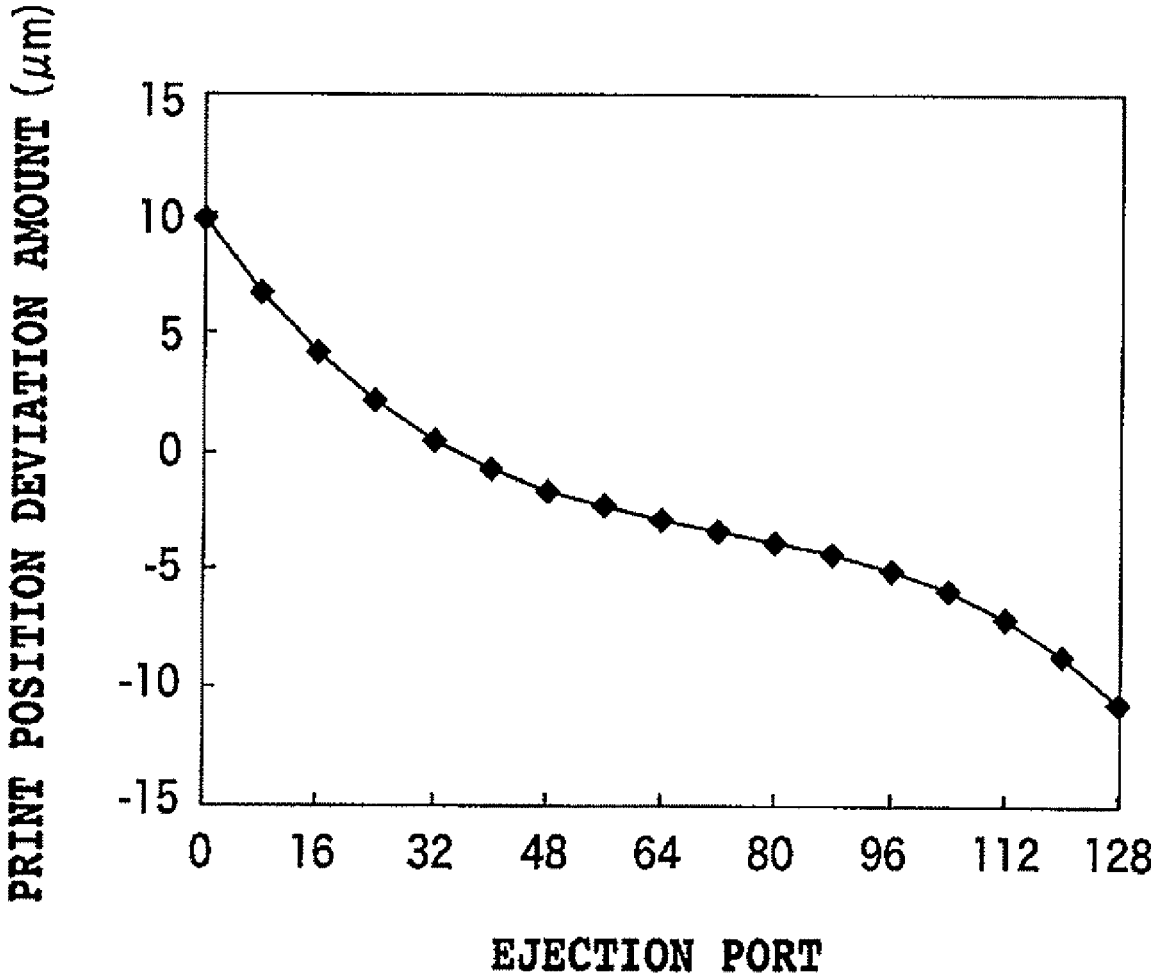
FIG. 2 is a graph showing test results that the inventors performed to check the degree of the "end-deviation"
Figure 3:
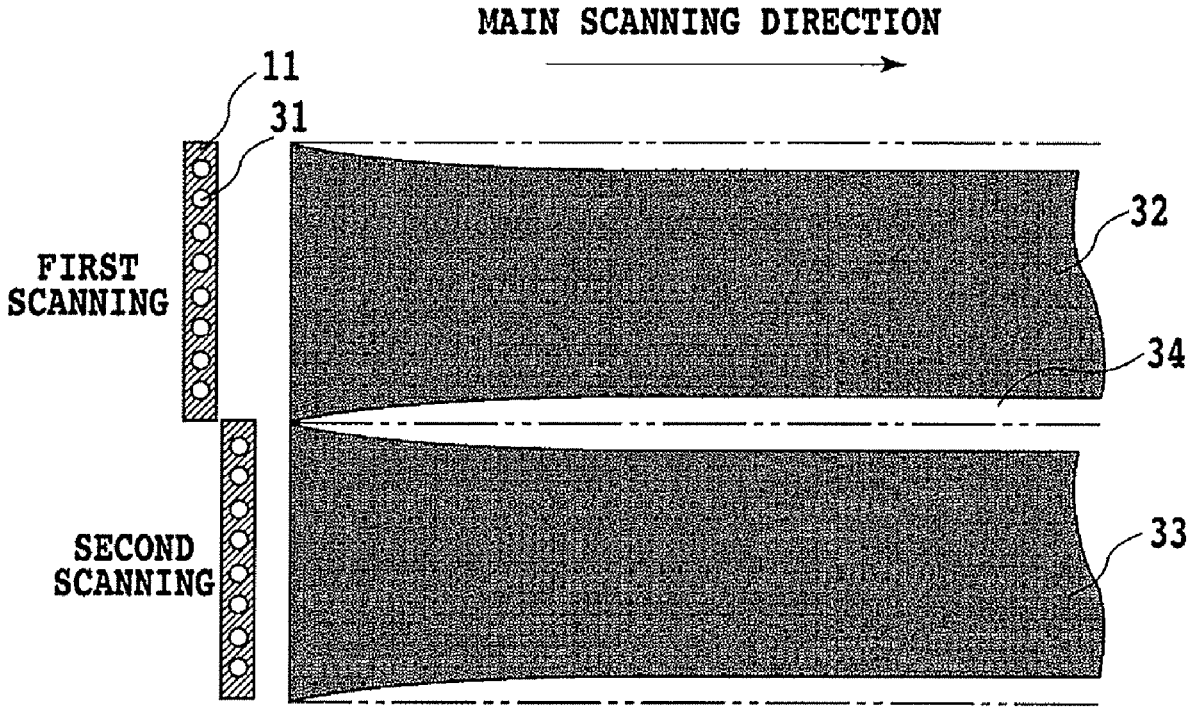
FIG. 3 is a view showing a print state in the case of actually printing an image with the printing head which generates the end-deviation.
Figure 4:
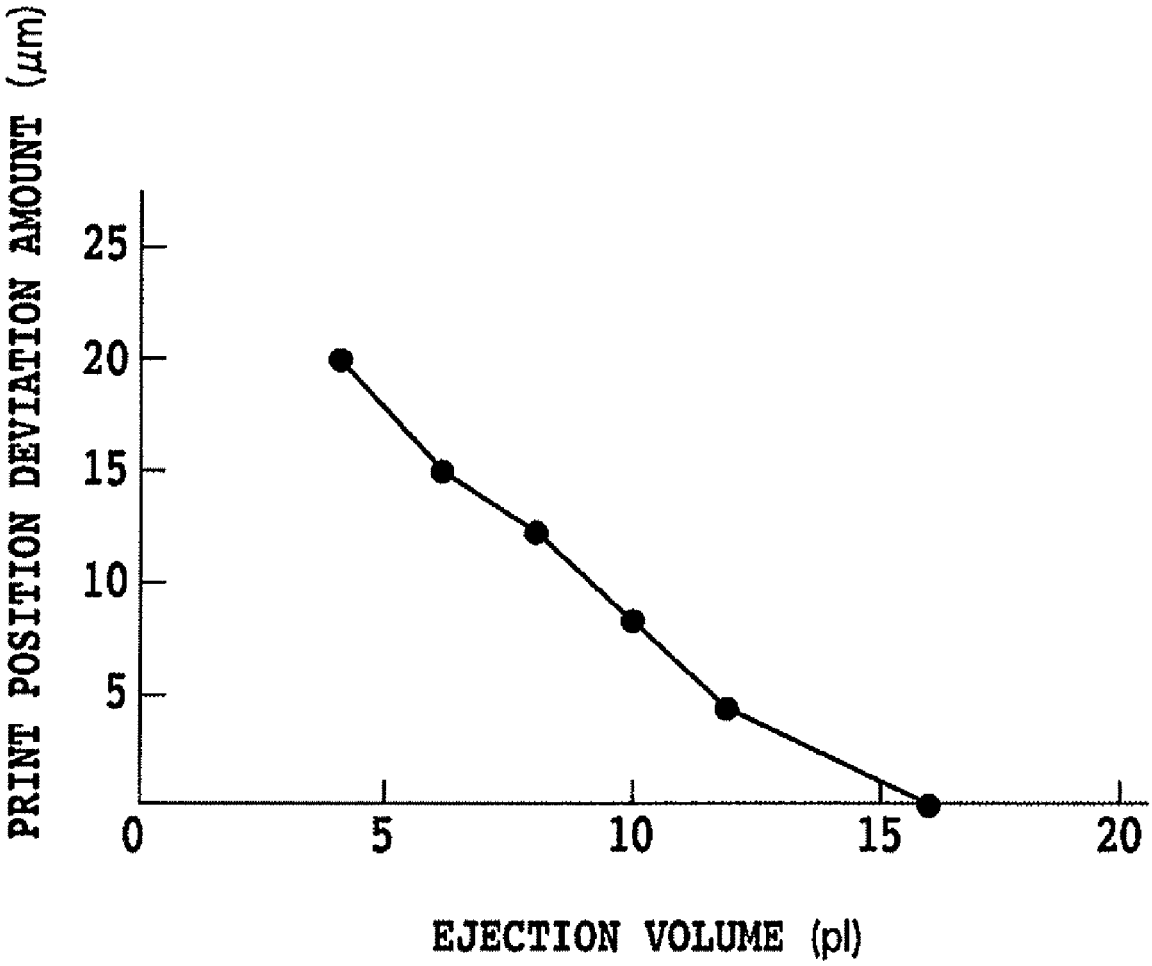
FIG. 4 is a graph showing a relationship between an ejection volume and an end-deviation amount.
Figure 5:
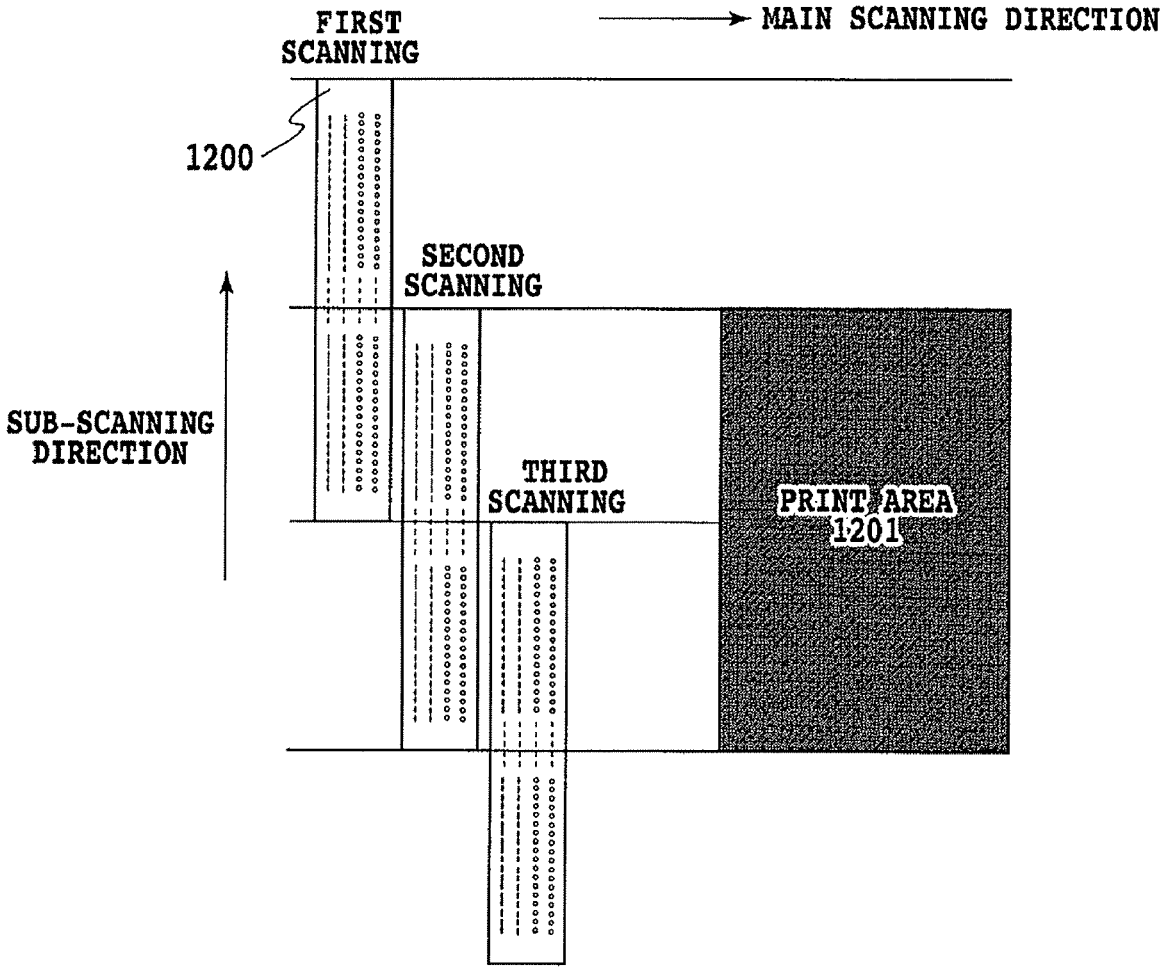
FIG. 5 is an explanatory schematic view of a multi-pass printing method.
Figure 6:
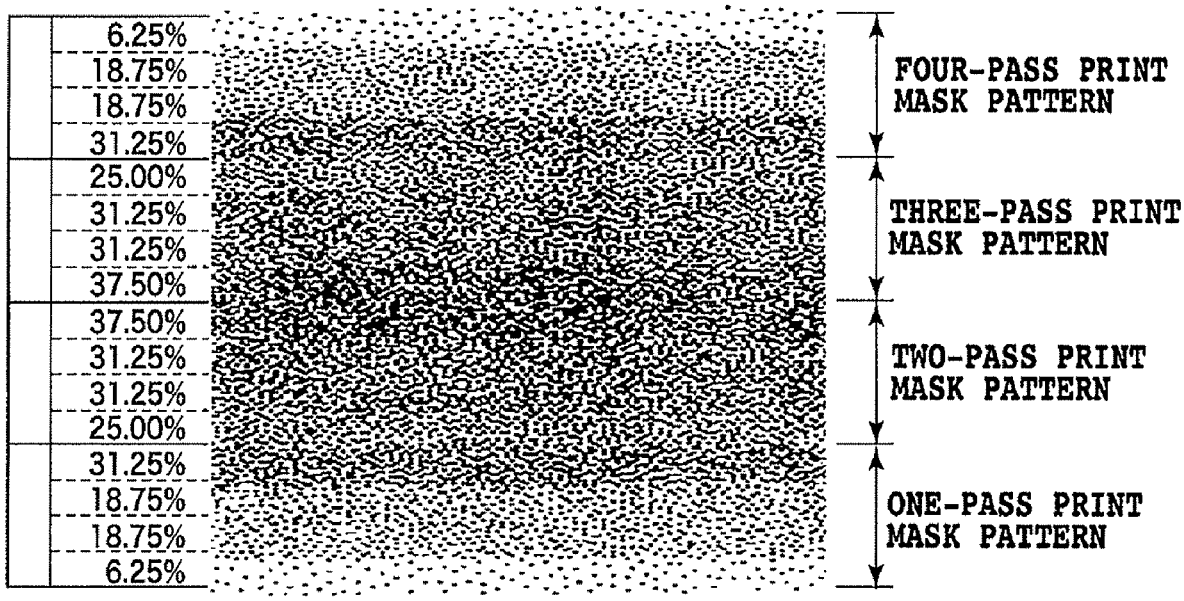
FIG. 6 is a view showing mask pattern which is improved to avoid the end-deviation.
Figure 7:
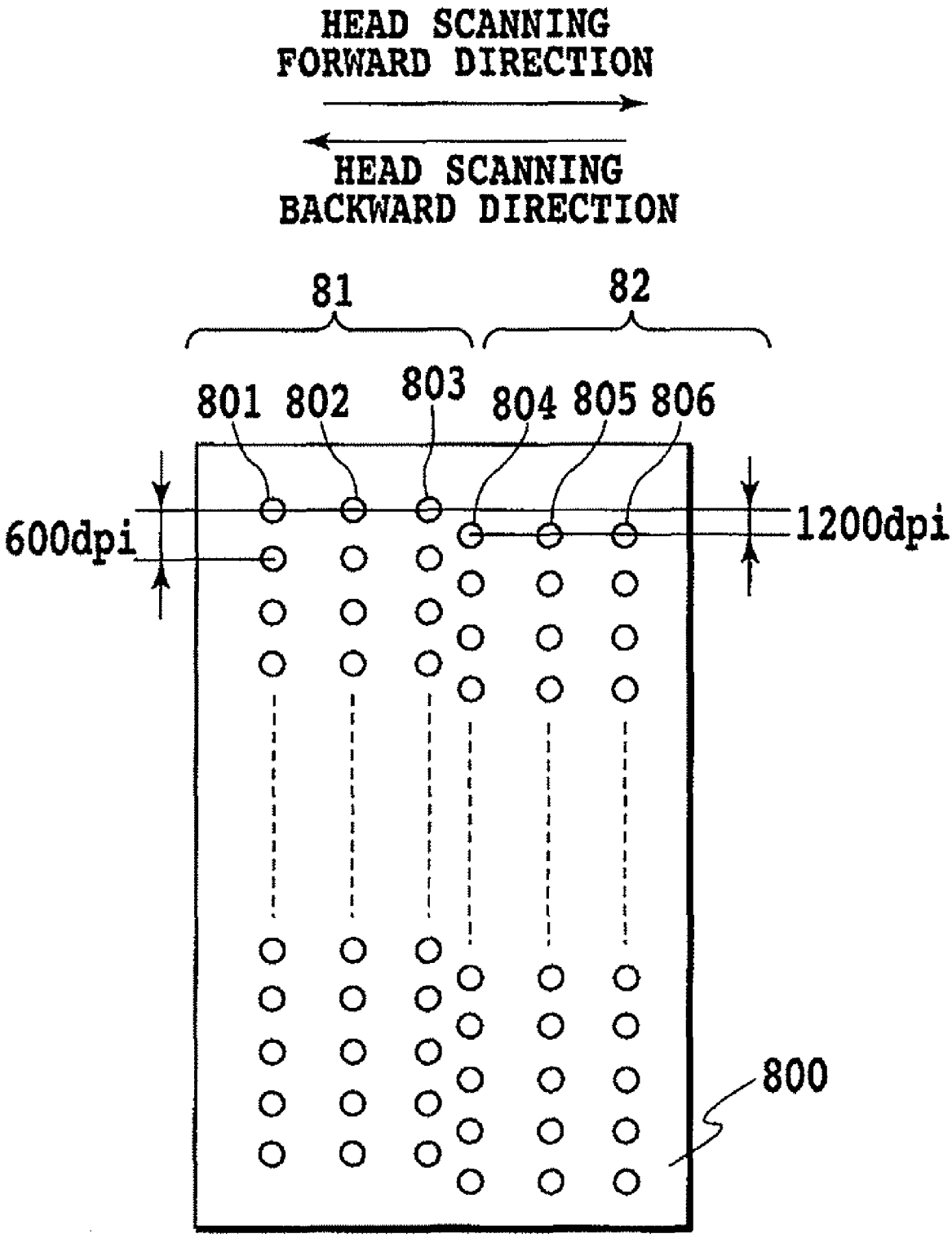
FIG. 7 is a schematic view showing an example of arrangement states of ejection port arrays in a bidirectional head.
Figure 8:
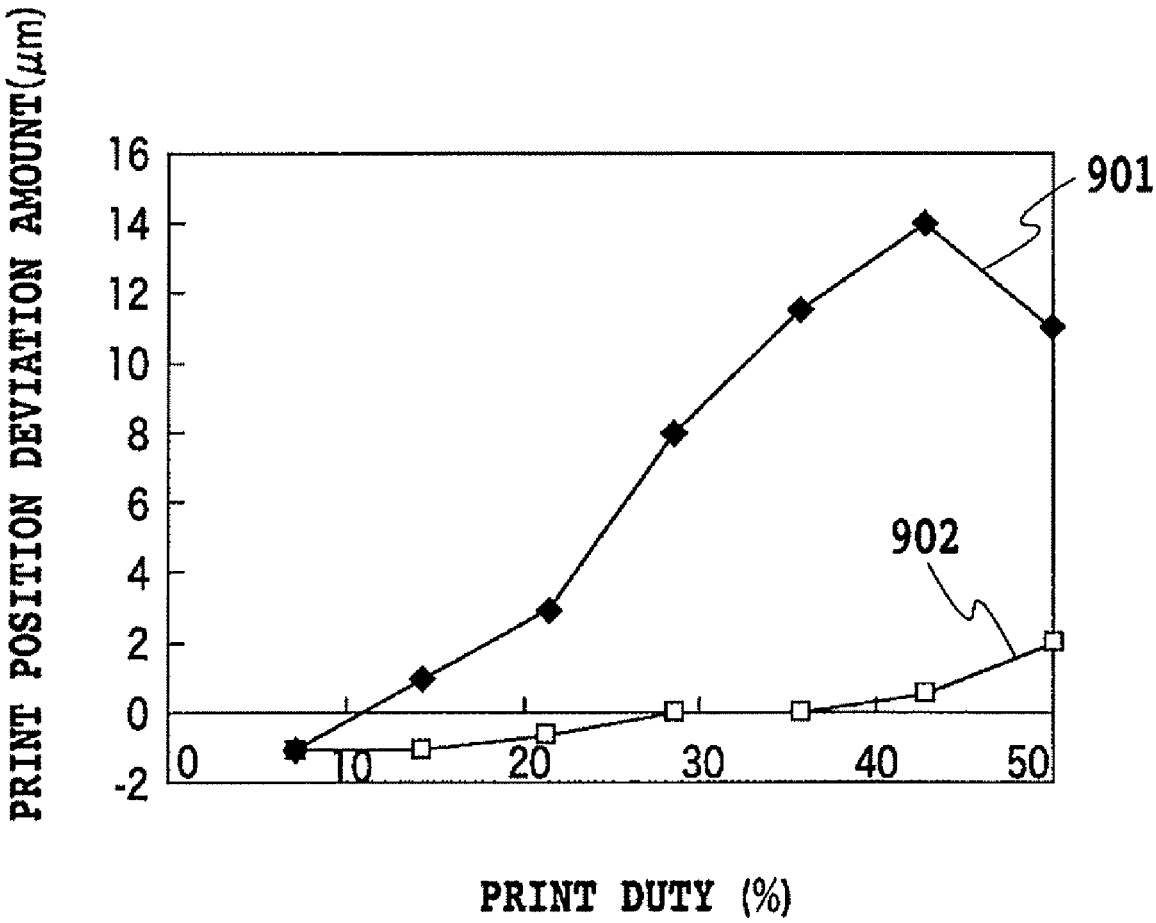
FIG. 8 is a graph showing test results which were performed by the inventors to compare print position deviation amounts with each other in two sets of nozzle arrays in which distances between ejection port arrays are different from each other.
Figure 9A:
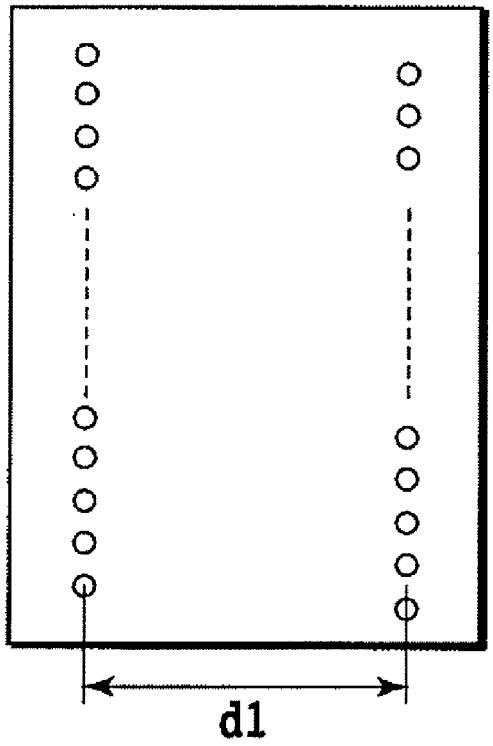
FIGS. 9A and 9B are schematic views showing a relationship between an arrangement density of ejection ports and airflow.
Figure 9B:
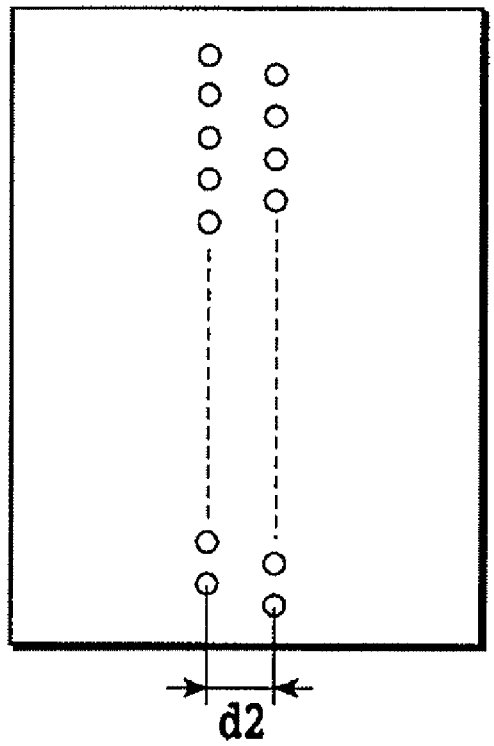

In the following second print scanning, printing is performed for the remaining pixels of 50% in backward direction in the image area, where the printing has already been performed for the pixels of approximately 50% by the first print scanning, via the 128 ejection ports positioned at the upper half part of the printing head 1. In addition, in the second print scanning, the lower half part of the printing head 1 performs printing for pixels of approximately 50% of a blank area adjacent to the image area. When the second print scanning ends, the print medium is further conveyed in the sub-scanning direction in FIG. 5 by the length corresponding to half of the print width of the printing head 1. An image is formed in stages by alternately repeating the above reciprocation print main scanning for the pixels of approximately 50% and the sub-scanning of the length corresponding to half of the print width. An approximately 50% printing in each print scanning is performed with the mask pattern prepared in advance.

Figure 16:
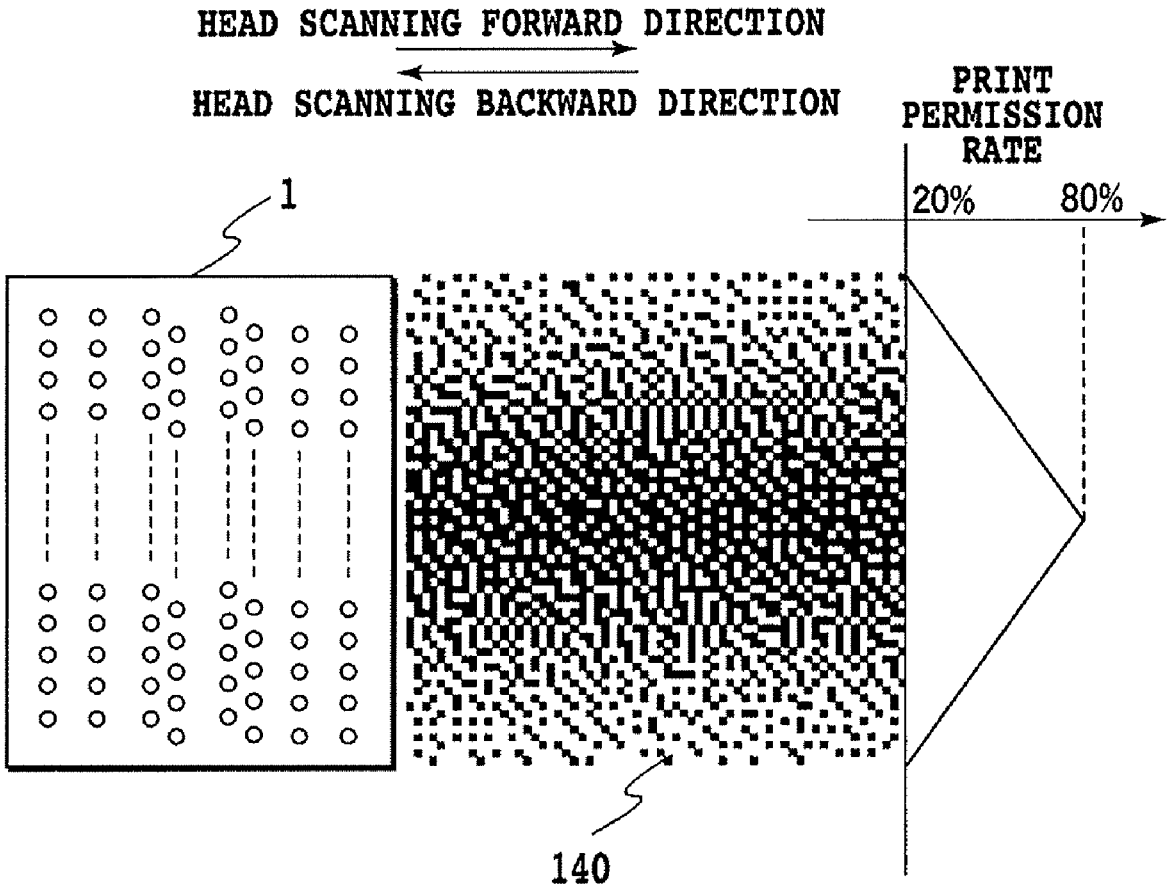
FIG. 16 is a view showing a conventional general two-pass mask pattern for preventing an end-deviation.

FIG. 16 is a view showing a conventional general two-pass mask pattern for preventing an end-deviation as disclosed in Japanese Patent Laid-Open No. 2002-292910, etc. The size of a mask pattern 140 is 256 pixels each in the vertical and horizontal directions. A pixel shown by black is a print permission pixel, and a pixel shown by white is a print non-permission pixel. The print permission and print non-permission of each pixel are determined so that two mask patterns corresponding to two vertically divided ejection port groups are respectively complementary to each other at 50% each.

Although the print permission rates to the pixels corresponding to the upper and lower ejection port groups are respectively 50% each, there is provided a bias in the number of print permission pixels in accordance with positions of the ejection ports. That is, although the print permission rate of the ejection port positioned at the outermost end is 20%, the print permission rate slowly rises as the position of the ejection port becomes close to the center, and is 80% at the center. The print permission rate of the ejection port at the end is thus made lower than that of the ejection port at the center so that adverse effects due to impact position deviations of the ink droplets ejected from the ejection ports at the end can be made inconspicuous. A mask pattern having a distribution of such print permission rates will be referred to as gradation mask hereinafter.

Figure 17:
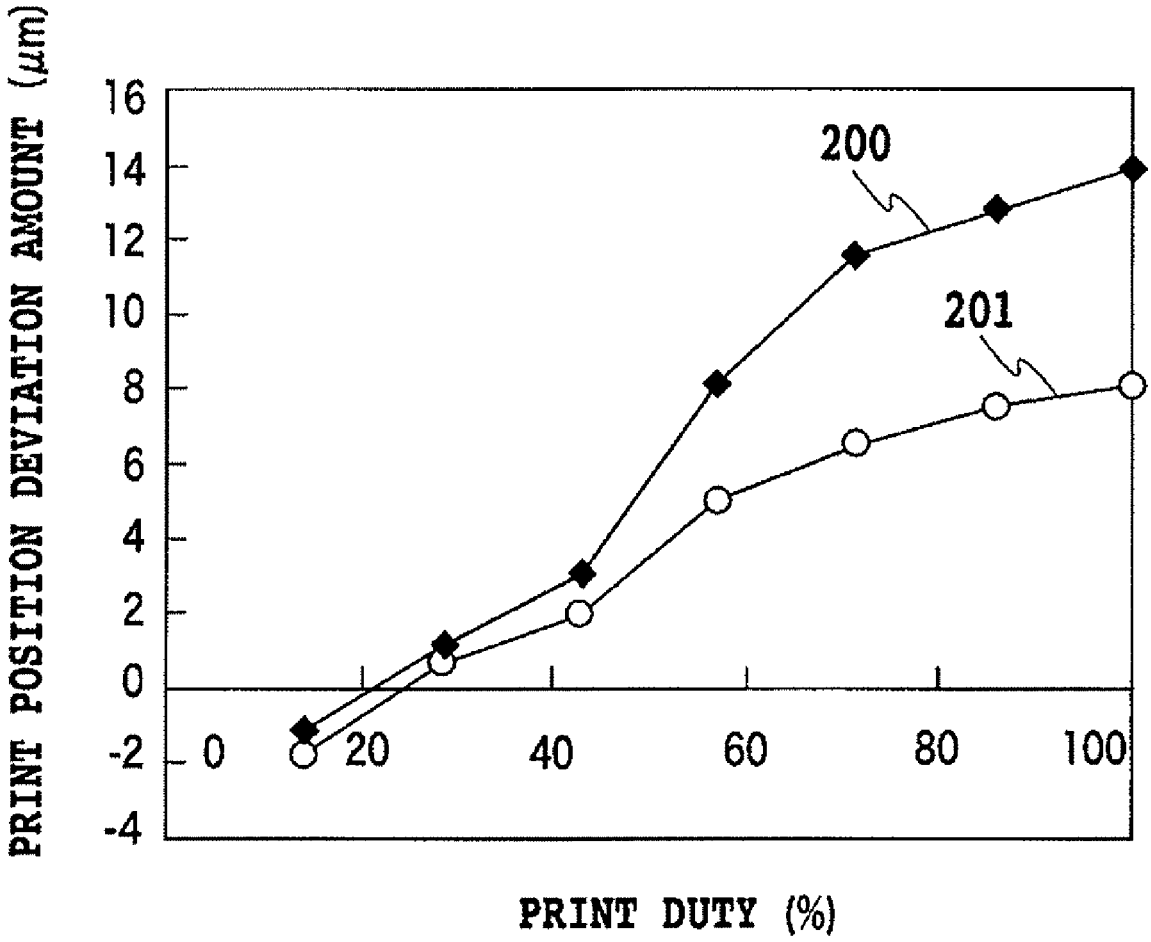
FIG. 17 is a graph showing a state of the end-deviation in printing the monotone image while changing the print duty for every type of mask pattern.

FIG. 17 is a graph showing a state of the end-deviation in printing the monotone image while changing the print duty for two types of mask patterns. In FIG. 17, a curved line 200 indicates the print position deviation amount of the ejection port positioned at the end in performing the two-pass type multi-pass printing with use of the mask pattern having the print permission rate of 50% uniformly across the entire ejection port area. On the other hand, a curved line 201 indicates the print position deviation amount of the ejection port positioned at the outermost end in performing the two-pass type multi-pass printing with use of the gradation mask shown in FIG. 16. FIG. 17 reveals that the end-deviation is reduced when the gradation mask is used.

Figure 18A:
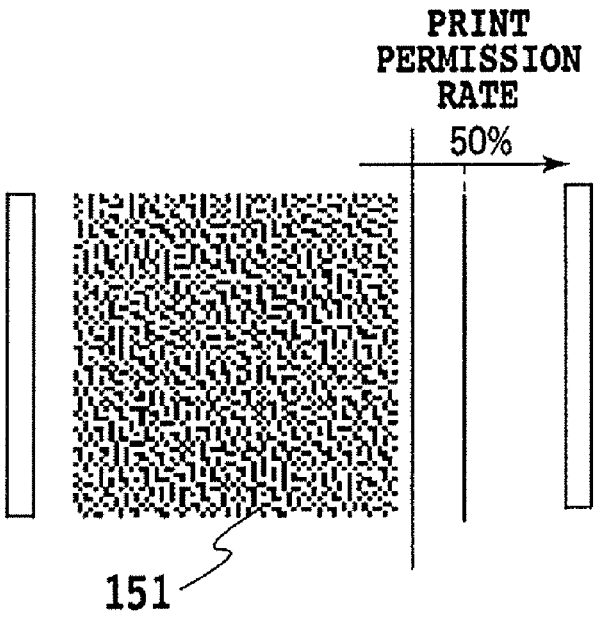
FIGS. 18A to 18C are views respectively showing three types of mask patterns which the inventors prepared to inspect an effect that a distribution of print permission rates of a gradation mask has on the end-deviation.
Figure 18B:
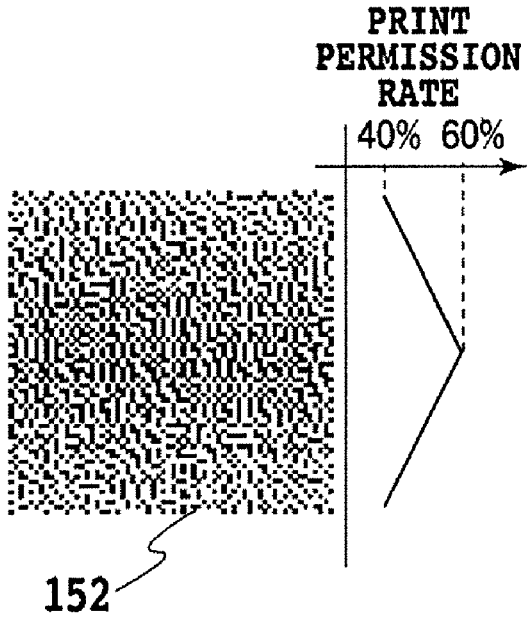
Figure 18C:
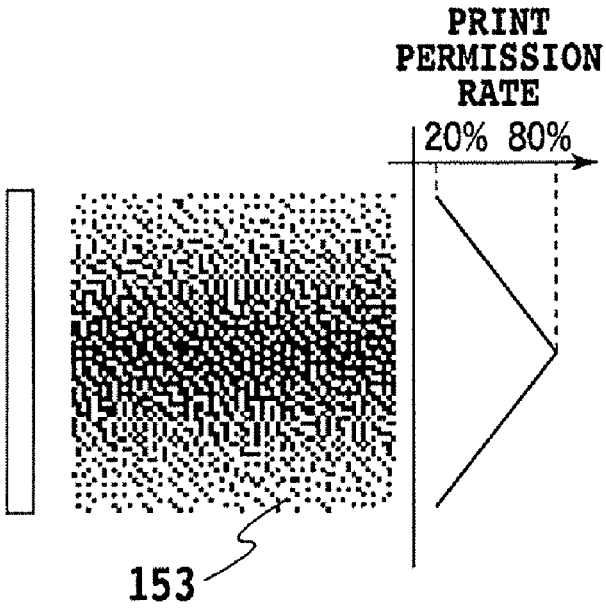

FIGS. 18A to 18C are views showing three types of mask patterns respectively which the inventors prepared to investigate the effect that a distribution of print permission rates of a gradation mask has on the end-deviation. FIG. 18A shows a mask pattern 151 having the print permission rate of 50% uniformly across the entire ejection port area. FIG. 18B shows a gradation mask 152 in which the print permission rate is set to 40% at the outermost end, and is set to 60% at the center. Furthermore, FIG. 18C shows a gradation mask 153 in which the print permission rate is set to 20% at the outermost end, and is set to 80% at the center. The inventors observed states of the end-deviation using the above three types of mask patterns.

Figure 19:
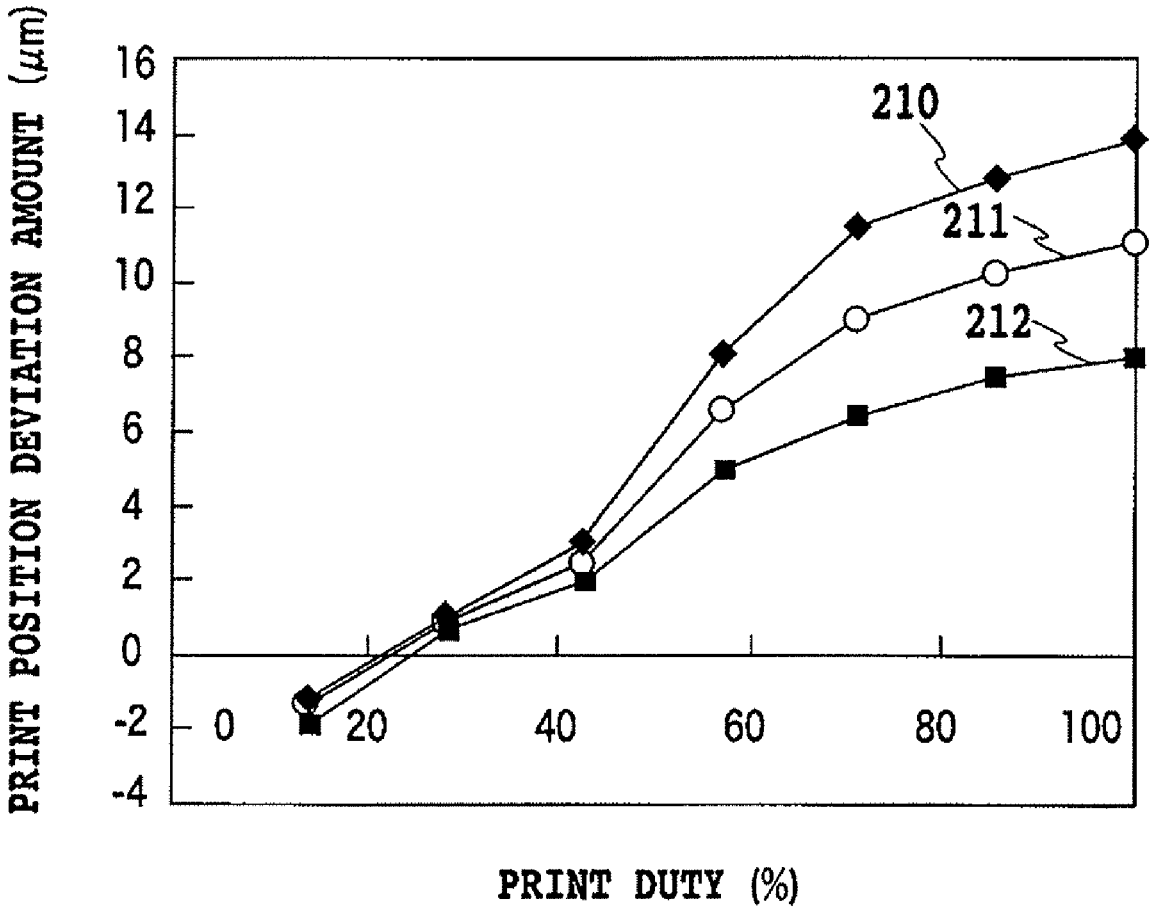
FIG. 19 is a graph showing a state of the end-deviation in printing the monotone image while changing the print duty for three types of mask patterns.

FIG. 19 is a graph showing a state of the end-deviation in printing the monotone image while changing the print duty for every type of mask pattern shown in FIGS. 18A to 18C. In FIG. 19, a curved line 210 indicates a print position deviation amount of the nozzle positioned at the outermost end in performing the two-pass type multi-pass printing with use of the mask pattern 151 shown in FIG. 18A. On the other hand, a curved line 211 indicates a print position deviation amount of the nozzle positioned at the outermost end in performing the printing with use of the gradation mask 152 shown in FIG. 18B. Furthermore, a curved line 212 indicates a print position deviation amount of the nozzle positioned at the outermost end in performing the printing with use of the gradation mask 153 shown in FIG. 18C. FIG. 19 reveals that the end-deviation is small as a difference (inclination) between the print permission rates of the end and center of the gradation mask is large.

That is, marking only the end-deviation, it is possible to determine that a larger inclination in the gradation mask is more efficient for reduction in the end-deviation. However, some new problems have arisen due to increasing the inclination. Such problems will be concretely described hereinafter.

As a first problem, reduction in the multi-pass effect is cited. As described above, one of the effects of the multi-pass printing method is that even if there are variations in the ejecting direction and ejection volume among the ejection ports, adverse effects due to variations can be made inconspicuous on the image. This effect would be obtained if a plurality of dots arranged on the print medium in the main scanning direction were printed as equally as possible by the plurality of different ejection ports. However, in the case where the gradation mask is employed in which the difference between the print permission rates is large as shown in FIG. 18C, the possibility that a dot printed by a ejection port positioned at the center is higher, a great number of dots arranged in the main scanning direction were printed by the same ejection port. Specifically, in an area through which the ejection port positioned at the center passes, the dots of 80% are printed via the same ejection port. Accordingly, if a large deviation is included in the ejection ports positioned at the center, the dots of 80% aligned in the area through which the ejection port passes are deviated. As a result, streaks or density unevenness easily appear in the obtained image. That is, the effect of the multi-pass printing can hardly appear in the area.

In addition, since the ink for printing the dots of 80% drops on the print medium at once at the center, there is a risk that the ink droplets adjacent to each other are mixed before the print medium absorbs the ink to increase graininess. When the same gradation mask is used for all the ejection port arrays, the graininess more easily appears.

As a second problem, a printing head life is cited. In each ejection port of the inkjet printing head, ejecting performance is inevitably slowly declined as the number of ejection is increased. When one ejection port loses ejecting performance or the ejecting performance thereof is extremely declined, there are many cases where it is determined the life of the inkjet printing head itself ends. Accordingly, there is a concern that the gradation mask having a bias in the frequency of ejecting makes the printing head life short. The tendency of the short printing head life clearly appears as the inclination between the print permission rates in the gradation mask becomes large.

For that reason, in consideration of the degree of the end-deviation, the gradation mask is desired to be designed so that the inclination is suppressed to a minimum. As described with reference to FIG. 14, when a difference between the degrees of the end-deviations appears depending on the positions of the ejection port arrays arranged in the printing head, it is desirable that the degree of the inclination is adjusted for every ejection port array in accordance with the degree of the end-deviation.

As such, in the embodiment, the gradation mask pattern 153, in which the print permission rate is changed from 20% to 80% as shown in FIG. 18C, is applied to the ejection port arrays Y1 and Y2, and Bk1 and Bk2 each having the largest end-deviation. In addition, the gradation mask pattern 152, in which the print permission rate is changed from 40% to 60% as shown in FIG. 18B, is applied to the ejection port arrays M1 and M2 having the medium end-deviation. Furthermore, the mask pattern 151 having the uniform print permission rate of 50% shown in FIG. 18A is applied to the ejection port arrays C1 and C2 for which almost no end-deviation appears.

Figure 20:
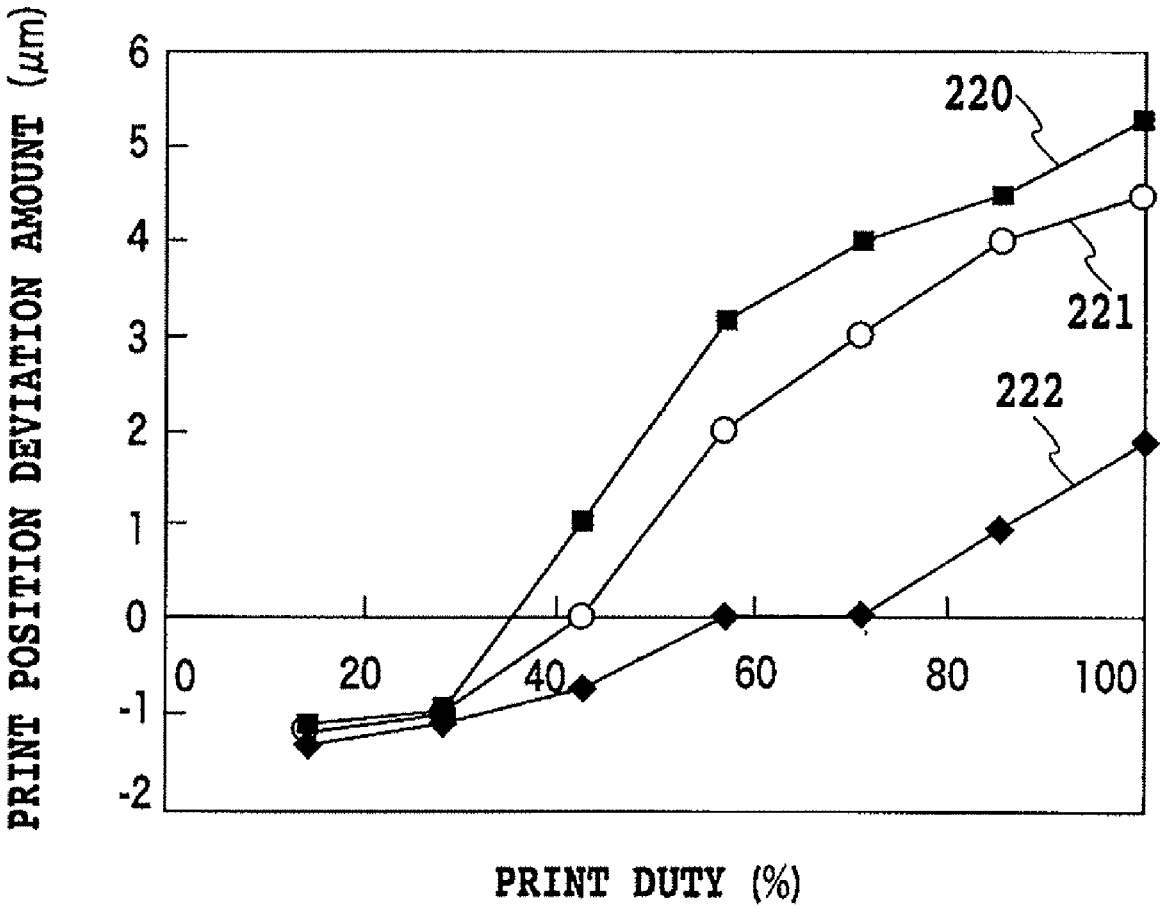
FIG. 20 is a graph showing a state of the end-deviation of each ejection port array in printing the monotone image of each color with the three types of mask patterns respectively applied to the ejection port arrays of each color.

FIG. 20 is a graph showing a state of the end-deviation of each ejection port array in printing the monotone image of each color under conditions similar to the conditions in FIG. 14 with the three types of mask patterns applied to the ejection port arrays of each color respectively. A curved line 220 indicates a print position deviation amount of the outermost end of the ejection port arrays Y1 and Y2 of yellow, a curved line 221 indicates a print position deviation amount of the outermost end of the ejection port arrays M1 and M2 of magenta, and a curved line 222 indicates a print position deviation amount of the outermost end of the ejection port arrays C1 and C2 of cyan. Regarding the ejection port arrays of cyan for which the mask pattern each having the uniform print permission rate of 50% is used, the same results (curved line 222) as that of FIG. 14 are obtained. However, regarding the ejection port arrays of magenta and yellow, the print position deviation amounts are reduced by the effect of the gradation mask compared with the print position deviation amounts shown in FIG. 14.

Thus, as the distance between the ejection port arrays for ejecting the same color becomes short, use of the gradation mask having a large inclination between the print permission rates suppresses the end-deviation and simultaneously suppresses various potential adverse effects to a minimum, and enables an image excellent in uniformity to be output.

Moreover, when the printing heads of the embodiment are used, the effect of the embodiment can be obtained even if the gradation mask 153 shown in FIG. 18C is used for only yellow and black, and if the mask patterns 151 shown in FIG. 18A are uniformly used for magenta and cyan. If a difference between conspicuousness of the end-deviations in yellow and black appears, gradation masks having inclinations different from each other may be used for yellow and black respectively.

Second Embodiment

A second embodiment of the present invention will be described hereinafter. The inkjet printer and inkjet printing heads as described with reference to FIG. 10 to FIG. 12 are used in the embodiment similarly to the first embodiment. However, the arrangement of each ejection port is different from that of the first embodiment.

Figure 21:
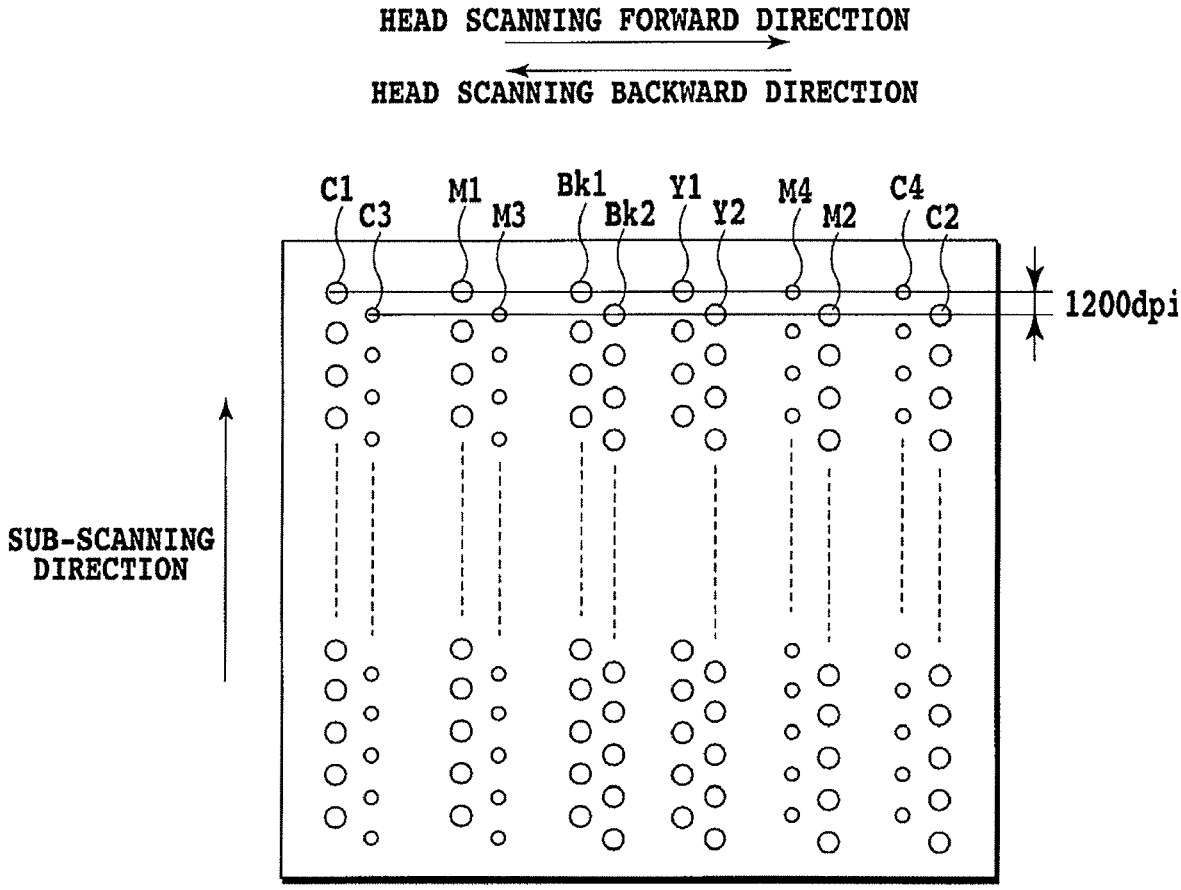
FIG. 21 is a view showing a printing head, which is observed from an ejection port surface side, according to a second embodiment of the present invention.

FIG. 21 is a view showing a printing head, which is observed from an ejection port surface side, used in the second embodiment. Twelve large and small ejection port arrays in total are arranged on a substrate of the embodiment, and 128 ejection ports are arranged in each ejection port array at pitches of 600 dpi. The cyan ink is ejected from ejection port arrays C1, C2, C3 and C4, the magenta ink is ejected from ejection port arrays M1, M2, M3 and M4, the yellow ink is ejected from the ejection port arrays Y1, Y2, and the black ink is ejected from the ejection port arrays Bk1, Bk2. The two ejection port arrays adjacent to each other (for example, C1 and C3) for ejecting the same color ink are arranged so as to be deviated from each other by a half pitch in the sub-scanning direction. The ink droplets of 2.8 pl are ejected from the ejection port arrays C1, C2, M1, M2, Y1, Y2, Bk1 and Bk2, and ink droplets of 0.6 pl are ejected from the ejection port arrays C3, C4, M3 and M4.

When an image is thus formed in a plurality of stages of ejection volume regarding one color, print data is adjusted for every ejection port array in accordance with an input density signal.

Figure 22:
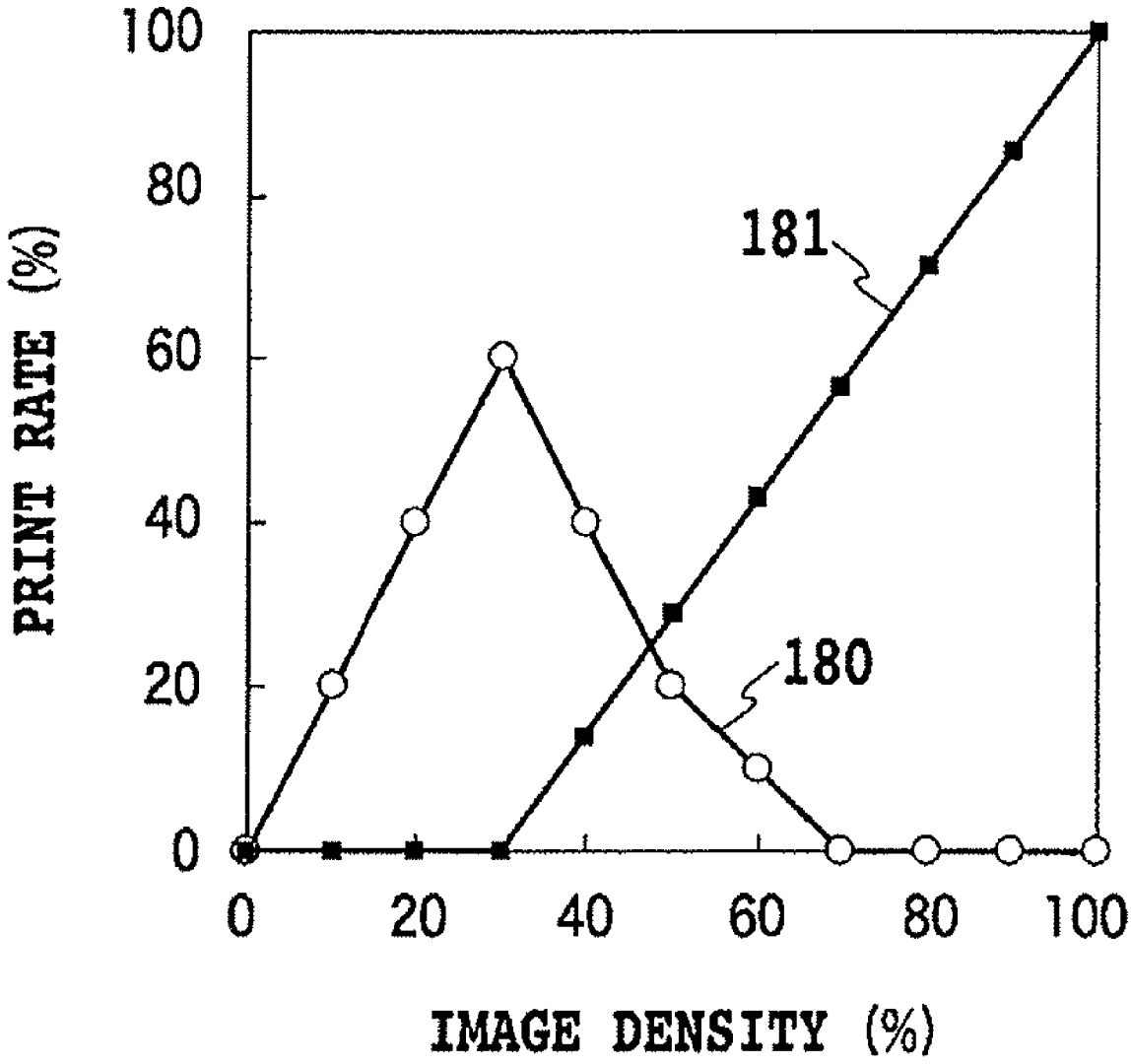
FIG. 22 is a graph showing each print rate of ejection port arrays, of which ejection volumes are different from each other, to an input density signal.

FIG. 22 is a graph showing each print rate of ejection port arrays, of which the ejection volumes are different from each other, to the input density signal. Here, the print rate of 100% indicates a state where the ink droplets are printed on all the pixels one by one. Printings with a large dot (2.6 pl) and small dot (0.6 pl) are possible for all the pixels. However, when an image density is low, only the printing with the small dot is performed. When the image density is raised to a degree (30% in this case), the printing with the large dot is started, the rate thereof is slowly increased, and simultaneously the rate of the printing with the small dot is slowly reduced. When the image density becomes maximum (100%), all the pixels is printed with the large dot.

Figure 23:
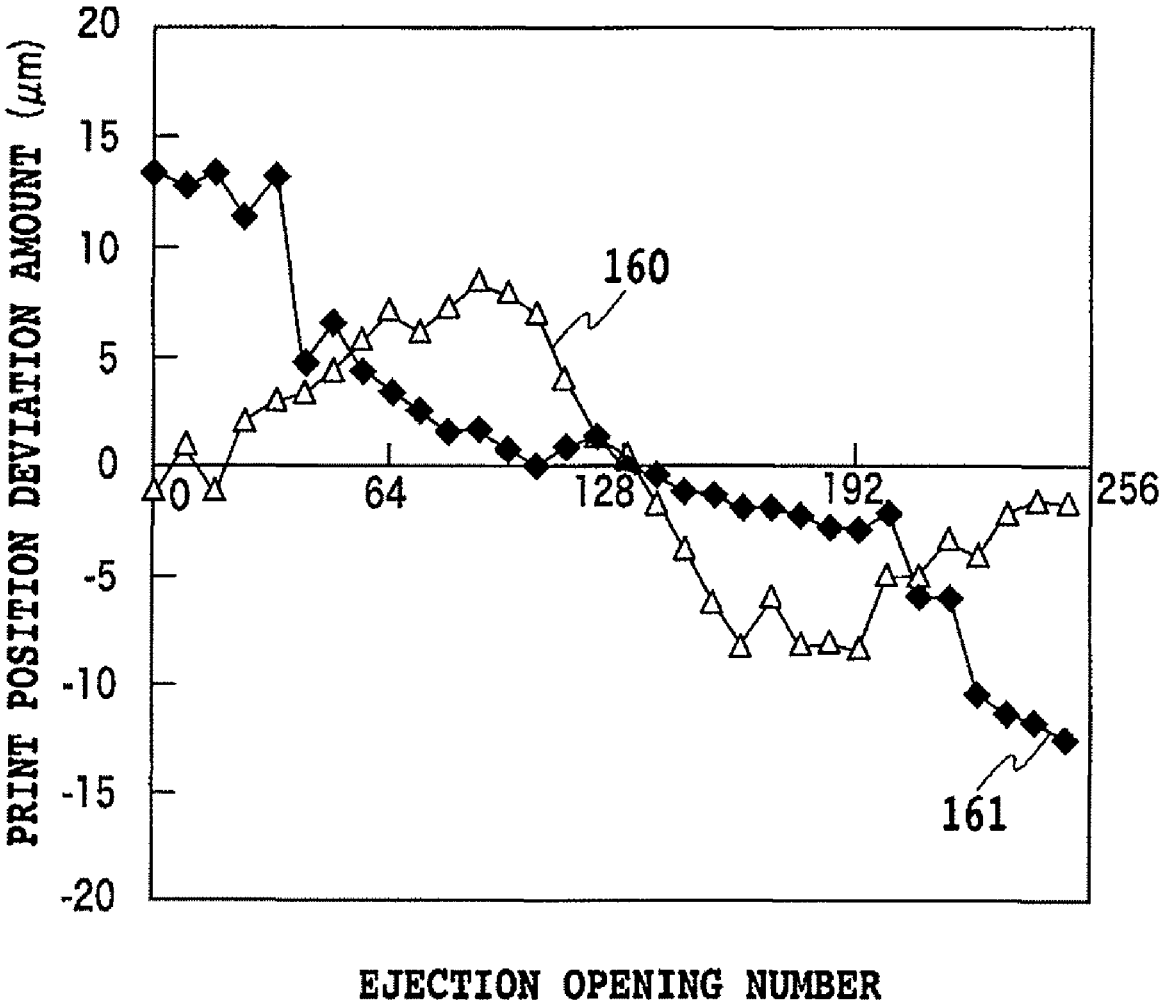
FIG. 23 is a graph showing test results that the inventors performed to check the degree of the end-deviation.

FIG. 23 is a graph showing test results that the inventors performed to check the degree of the end-deviation regarding the printing head shown in FIG. 21. Here, the results are shown in the case where the distance to the paper is 1.15 mm and the ejecting frequency is 25 KHz. The horizontal axis in FIG. 23 indicates each arrangement position of aligned ejection ports. The vertical axis thereof indicates a deviation amount of an actual impact position of the ink droplet ejected from each ejection port to a target position. A curved line 160 indicates a print position deviation amount in performing 100% printing with the ejection port arrays C3 and C4. A curved line 161 indicates a print position deviation amount in performing 50% printing with the ejection port arrays Y1 and Y2. FIG. 23 reveals that the degree of the print position deviation of the ejection port arrays Y1 and Y2 of yellow, between which the distance is shorter than that between the ejection port arrays C3 and C4, is larger than that of the ejection port arrays C3 and C4 regardless of the lower print rate.

Accordingly, in the embodiment, the gradation mask 153 having the largest inclination shown in FIG. 18C is used for the ejection port arrays Y1 and Y2, and Bk1 and Bk2 each between which the distance is shorter. The gradation mask 152, in which the print permission rate is changed from 40% to 60% as shown in FIG. 18B, is applied to the ejection port arrays M1, M2 between which the distances are longer than that of yellow or black, and which causes concern for the possibility of medium end-deviation. Furthermore, the mask pattern 151 having the uniform print permission rate of 50% as shown in FIG. 18A is applied to the ejection port arrays C1, C2 via which almost no end-deviation appears.

Moreover, referring to FIG. 22, there is no print rate of 60% or more on image processing regarding the nozzle arrays (C3, C4, M3 and M4) each having a small ejection volume. Accordingly, since it is assumed that almost no end-deviation is confirmed, the mask pattern 151 having the uniform print permission rate of 50% as shown in FIG. 18A is applied to the nozzle arrays C3, C4, M3 and M4 in the embodiment. However, when the end-deviation becomes conspicuous due to the small ejection volume or fluctuation of the distance to the paper, a proper gradation mask can be used for these ejection port arrays.

It is preferable that the degree of the inclination of the gradation mask is thus adjusted in consideration of not only the distance between the ejection port arrays in the printing head but also the kind and ejection volume of the ink, and the maximum print rate of the image processing. For example, when particular color inks such as red, green and blue are used other than the basic color inks, cyan, magenta, yellow and black, it is assumed that the maximum print rate of the particular color inks would become lower than that of the basic four color inks. In the case of the printing head in which ejection port arrays for ejecting inks including such particular color inks are symmetrically arranged, the distance between the ejection port arrays for ejecting the same ink is considered, and the gradation mask may be adjusted so that an inclination of the particular color ink is set lower than that of the basic color ink.

Third Embodiment

A third embodiment of the present invention will be described hereinafter. Also in the embodiment, the inkjet printer and the inkjet printing heads shown in FIGS. 10 to 12 are used similar to the above embodiments. However, arrangement of each ejection port is different from that of the above embodiments.

Figure 24:
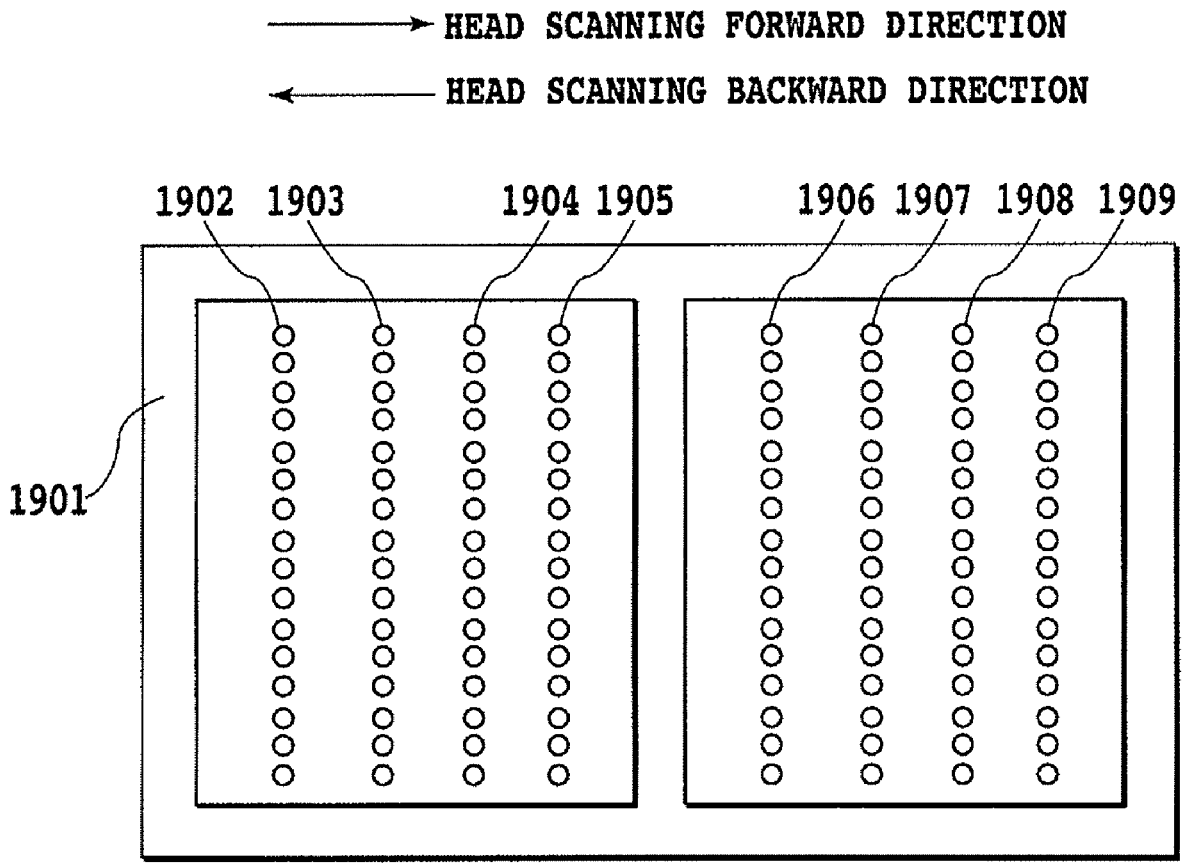
FIG. 24 is a view showing a printing head, which is observed from an ejection port surface side, according to a third embodiment of the present invention.

FIG. 24 is a view showing the printing head, which is observed from an ejection port surface side, according to the embodiment. The printing head of the embodiment is a dual head in which two substrates each provided with four ejection port arrays are juxtaposed. In the printing head of the embodiment, the ejection port arrays of each color are also symmetrically arranged in the main scanning direction. The cyan ink is ejected from ejection port arrays 1902 and 1909, the magenta ink is ejected from ejection port arrays 1903 and 1908, the yellow ink is ejected from ejection port arrays 1904 and 1907, and the black ink is ejected from ejection port arrays 1905 and 1906.

Even if the ejection port arrays are thus arranged, the end-deviation also appears similarly to the above embodiments, and the degree of the end-deviation is fluctuated in accordance with the distance between the two ejection port arrays. Accordingly, when the gradation mask shown in FIG. 18 is properly used for each ejection port array in accordance with the degree of the end-deviation, a smooth image having a small end-deviation can be output.

Moreover, it can be considered that the two-pass type printing having the highest print permission rate of each ejection port easily makes the end-deviation appear and exerts the effect of the present invention in the multi-pass printings. That is why the two-pass type multi-pass printing is cited as an example in the above description of the three embodiments. However, the present invention is not limited thereto. Even if multi-pass printing is performed with three or more passes, the degree of the end-deviation also depends on arrangement positions of the ejection port arrays. In the case of a printer having a plurality of printing modes of which the numbers of multi-passes are different from each other, when a gradation mask which corresponds to each of the ejection port arrays of each color is prepared for every printing mode, the function of the present invention can be more effectively exerted.

In addition, although two kinds of gradation masks are cited, in which the print permission rate is gradually changed as the position of the ejection port becomes close to the center as shown in FIG. 18, in the description of the above embodiments, the present invention, of course, is not limited to such mask patterns. As long as the mask patterns has complementary relationship in the multi-pass printing, various values can be further applicable to the print permission rates of the end and center of the ejection port. For example, the print permission rate of each ejection port may be changed relative to the ejection port array in stages. A mask may be employed, in which the print permission rate is varied in stages so as to be 20%, 40%, 60%, 80%, 60%, 40% and 20% for every predetermined number of ejection ports from the end in this order, in the present invention.

Furthermore, a plurality of ejection port array are not always required to be provided to all the inks in the present invention. The plurality of ejection port arrays may be provided for two or more inks in the present invention. Accordingly, for example, two ejection port arrays may be provided for cyan ink and magenta ink, and one ejection port array may be provided for the yellow ink and black ink, as an embodiment of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-130791, filed May 9, 2006, which is hereby incorporated by reference herein in its entirety.

What is claimed is:

1. An inkjet printer, comprising:

a printing unit configured to print an image on a print medium by ejecting ink from a printing head having at least first ejection port arrays and second ejection port arrays based on print permission rates determined in advance for the respective first and second ejection port arrays while moving the printing head with respect to the print medium, wherein the first ejection port arrays are for ejecting a first kind of ink and the second ejection port arrays are for ejecting a second kind of ink, wherein the first and second ejection port arrays are arranged in a moving direction, and wherein a distance between the first ejection port arrays is shorter than a distance between the second ejection port arrays, and a controller configured to cause the printing unit to print such that a difference between print permission rates of an end ejection port and a center ejection port in at least one of the first ejection port arrays is larger than a difference between print permission rates of an end ejection port and a center ejection port in at least one of the second ejection port arrays.

2. An inkjet printer according to claim 1, wherein the print permission rates are determined by a first mask pattern corresponding to the first ejection port arrays and a second mask pattern corresponding to the second ejection port arrays.

3. An inkjet printer according to claim 1, wherein the first and second ejection port arrays are disposed in the following order, in the moving direction, the second ejection port array, the first ejection port array, the first ejection port array, and the second ejection port array.

4. An inkjet printing method for printing an image on a print medium, the inkjet printing method comprising the steps of:

moving a printing head having at least first ejection port arrays and second ejection port arrays with respect to the print medium, wherein the first ejection port arrays are for ejecting a first kind of ink and the second ejection port arrays are for ejecting a second kind of ink, wherein the first and second ejection port arrays are arranged in a moving direction, and wherein a distance between the first ejection port arrays is shorter than a distance between the second ejection port arrays; and ejecting ink from the first ejection port arrays and the second ejection port arrays based on print permission rates determined in advance for the respective first and second ejection port arrays while moving the printing head, wherein a difference between print permission rates of an end ejection port and center ejection port in at least one of the first ejection port arrays is larger than a difference between print permission rates of an end ejection port and center ejection port in at least one of the second ejection port arrays.

* * * * *